US008602243B2

(12) United States Patent
Hunter

(10) Patent No.: US 8,602,243 B2
(45) Date of Patent: Dec. 10, 2013

(54) COLLAPSIBLE SEMI-BULK CONTAINER

(75) Inventor: Andrew Hunter, Mount Pleasant, SC (US)

(73) Assignee: Composite Containers LLC, Wando, SC (US)

( * ) Notice: Subject to any disclaimer, the term of this patent is extended or adjusted under 35 U.S.C. 154(b) by 0 days.

(21) Appl. No.: 13/211,034

(22) Filed: Aug. 16, 2011

(65) Prior Publication Data

US 2013/0043241 A1 Feb. 21, 2013

(51) Int. Cl.
*B65D 6/26* (2006.01)

(52) U.S. Cl.
USPC ..... 220/6; 220/651; 220/529; 220/520

(58) Field of Classification Search
USPC ..... 220/6, 9.1–9.3, 520, 529, 528, 554, 220/507, 651
See application file for complete search history.

(56) References Cited

U.S. PATENT DOCUMENTS

| | | | | |
|---|---|---|---|---|
| 728,749 | A * | 5/1903 | McCord | 229/117.04 |
| 3,527,339 | A * | 9/1970 | Cipolla | 206/290 |
| 4,210,186 | A * | 7/1980 | Belenson | 206/316.2 |
| 4,610,286 | A * | 9/1986 | Cyr | 206/316.2 |
| 4,720,020 | A * | 1/1988 | Su | 220/6 |
| 4,903,859 | A * | 2/1990 | Derby et al. | 383/41 |
| 5,181,612 | A * | 1/1993 | Liu | 206/546 |
| 5,323,922 | A | 6/1994 | Lapoint, Jr. et al. | |
| 5,328,042 | A * | 7/1994 | Heise | 220/7 |
| 5,671,858 | A * | 9/1997 | Hsu | 220/9.2 |
| 5,868,269 | A * | 2/1999 | Juarez | 220/529 |
| 6,203,198 | B1 | 3/2001 | Stone | |
| 6,220,755 | B1 | 4/2001 | Brown et al. | |
| 6,224,260 | B1 * | 5/2001 | Nickell et al. | 383/119 |
| 6,224,261 | B1 * | 5/2001 | Stone | 383/119 |
| 6,244,443 | B1 | 6/2001 | Nickell et al. | |
| 6,299,354 | B2 | 10/2001 | Nickell et al. | |
| 6,328,470 | B2 | 12/2001 | Brown et al. | |
| 6,394,277 | B2 | 5/2002 | Nickell et al. | |
| 6,415,927 | B1 | 7/2002 | Stone et al. | |
| D461,638 | S * | 8/2002 | Kellogg et al. | D3/304 |
| 6,484,898 | B2 * | 11/2002 | Hillis et al. | 220/6 |
| 6,520,364 | B2 * | 2/2003 | Spykerman et al. | 220/6 |

(Continued)

FOREIGN PATENT DOCUMENTS

| | | | |
|---|---|---|---|
| FR | 2111991 A * | 10/1969 | B29C 65/00 |
| WO | 01-98160 | 12/2001 | |

OTHER PUBLICATIONS

International Search Report and Written Opinion, corresponding to International Patent Application No. PCT/US2012/050754, dated Feb. 28, 2013.

*Primary Examiner* — J. Gregory Pickett
*Assistant Examiner* — Mollie Llewellyn
(74) *Attorney, Agent, or Firm* — Andrew D. Gerschutz; Moore & Van Allen, PLLC

(57) ABSTRACT

A flexible, collapsible semi-bulk container for storing and transporting content is provided. The container has the strength to hold up to two tons of contents while being stacked up to five high. The container is also collapsible for ease of storage and transport. In some embodiments, the container includes swing walls that provide support to the side walls when positioned substantially adjacent to them. In another embodiment, the container includes partial swing walls that support cassettes for dividing the container into smaller compartments. In a still further embodiment, the container includes an interior baffle for dividing the container into smaller compartments.

18 Claims, 26 Drawing Sheets

(56) References Cited

U.S. PATENT DOCUMENTS

| | | | | |
|---|---|---|---|---|
| 6,585,414 | B2 * | 7/2003 | Peska | 383/38 |
| 6,640,944 | B2 * | 11/2003 | Adams | 190/110 |
| 6,688,471 | B2 | 2/2004 | Stone et al. | |
| 6,935,508 | B2 | 8/2005 | Stone et al. | |
| 7,011,224 | B2 * | 3/2006 | Sheng-Bin | 220/6 |
| D625,922 | S * | 10/2010 | Rees et al. | D3/304 |
| 2007/0025647 | A1 | 2/2007 | Hamlin | |
| 2010/0012550 | A1 * | 1/2010 | Dedmon et al. | 206/600 |

* cited by examiner

COLLAPSIBLE SEMI-BULK CONTAINER

TECHNICAL FIELD

This invention relates generally to flexible intermediate semi-bulk containers also known as bulk bags, and more particularly to a composite container for receiving, storing, transporting, and discharging products.

BACKGROUND

Historically, flexible intermediate bulk containers (bulk bags) have been used for receiving, storing, transporting, and discharging dry flowable materials of all types. Bulk bags are typically constructed in square, rectangular, or circular shapes with lift straps attached to each of the uppermost corners of the bulk bag. Additionally, some content in the bulk bags can be deformed by the static and/or dynamic pressure in the bulk bags.

Typically, intermediate bulk containers (IBC's) store bulk contents in large volumes. The IBC's can be costly to transport due to their weight when loaded with content. Many IBC's are not collapsible because of the heavy weight that is transported and the difficulty in designing a container that can both support the weight of the contents and also collapse for ease of storage and return shipping.

Some shippers include cardboard dividers to separate intermediate bulk containers into smaller compartments but this approach has multiple drawbacks. First, the cardboard dividers are often not reusable because they are deformed during transport, which raises costs. Second, the cardboard dividers introduce box dust that can cause problems in manufacturing facilities as well as be a source of contamination in pharmaceutical and food-grade contents. Third, standard cardboard dividers have a greater x and y dimension than the bulk bags when folded flat, causing problems in storage and return shipping.

Thus, there is a need for a strong collapsible container that efficiently transports content and that can be divided into smaller sanitary compartments that can be used as an IBC or a flexible IBC.

SUMMARY OF INVENTION

The present invention relates generally to a collapsible semi-bulk container that provides improved storage, stacking ability, and strength. The containers are designed to store content such as injection molded plastic parts, pharmaceutical and personal hygiene products, food-related products, and the like. In general, the containers are manufactured of polyethylene or polypropylene fabric; have four walls, a bottom portion, and optionally a lid; and include stiffening panels in pockets formed in at least two of the walls. Preferably, the containers include stiffening panels in four of the walls. In some embodiments, the containers include swing walls, partial swing walls, or fabric baffles attached to interior portions of the walls.

The containers are designed to collapse to a substantially flat position, which allows the containers to be easily stored and transported. In an embodiment, the containers are loaded with content, efficiently transported in a stacked position, unloaded, and then the containers are collapsed for ease in return shipping. The containers save money for shippers by providing efficient transport, ease of return, and re-usability.

In one embodiment, the container includes a rigid front wall, a rigid back wall, and opposing side walls defining four corners. The container also includes two swing walls, wherein an end of each swing wall is attached to the corners defined by the back wall and the opposing side walls. The other end of each swing wall moves freely in the interior of the container. The swing walls are configured to move between a position substantially adjacent to the back wall and a position substantially adjacent to a side wall. In one embodiment, the swing walls extend the length of the side walls when positioned substantially adjacent to them. The swing walls support the container when positioned substantially adjacent to the side walls but allow the container to collapse when positioned substantially adjacent to the back wall.

In a still further embodiment, the container includes a rigid front wall, a rigid back wall, and opposing side walls defining four corners. An interior baffle connects at least two opposing walls. In one embodiment, the baffle includes pockets for receiving stiffening panels. The baffles prevent static load, if non-rigid, and dynamic load, if rigid, from damaging the contents of the containers.

In another embodiment, the container includes a rigid front wall, a rigid back wall, and opposing side walls defining four corners. The container also includes at least one partial swing wall attached to the back wall and at least one partial swing wall attached to the front wall. The partial swing walls are configured to move between a position substantially adjacent to the wall that they are attached to and a position perpendicular to the wall that they are attached to. The partial swing walls are configured to support a cassette when the partial swing walls are perpendicular to the front and back walls. The cassette and the partial swing walls divide the container into multiple smaller compartments. Tiers of partial swing walls may be included in the container for creating different levels of compartments in the container. Without the protecting walls of the partial swing walls and cassette, the contents could be deformed by the pressure exerted from the load of contents in the larger volume of the undivided container. When the cassette is removed and the partial swing walls are positioned substantially adjacent to the wall to which they attach, the container can be folded flat for storage and transport.

DETAILED DESCRIPTION

The present invention generally relates to semi-bulk containers, methods for transporting and storing content in semi-bulk containers, and uses of semi-bulk containers. It is to be understood that the semi-bulk container described herein can be compatible with and may be used for storing and transporting any type of content. The semi-bulk container provides mechanical support and resistance to dynamic and static pressure for content in the semi-bulk container. The container is designed to control deflection of the walls so that the content in the interior of the container is placed under less pressure. Additionally, the containers are designed to be stackable, reusable, and collapsible. Surprisingly, the containers may be stacked up to five high while containing loads of up to two metric tons each. The containers are designed to support up to about 20,000 pounds per square inch even if the containers are empty or if the lid is punctured. Plastic rigid panels support up to about 13,000 pounds per square inch while plywood rigid panels support up to about 20,000 pounds per square inch. It should be understood that varying the width of the rigid panels will also affect the weight the panels are able to support. The container easily meet the minimum federal requirements of a 5:1 safe stacking factor for single use and the 6:1 safe stacking factor for reusable containers.

The containers are designed for semi-bulk storage of up to about 4400 lbs and can retain their shape when loaded with up to two metric tons. The design of the container minimizes bulging sides caused by heavy loads. Additionally, the containers weigh less than metal, wood, or plastic containers but can store products and be transported with at least the same level of efficiency. Further, the synthetic material used to manufacture the walls eliminates concerns related to cardboard or plywood such as dust that can contaminate pharmaceutical, food and personal hygiene products or damage sensitive equipment.

Any type of product may be transported in the containers. For example, solids or liquids can be transported in the semi-bulk containers. Solids can include, but are not limited to, powders, pre-formed components, and semi-solids. Liquids can include, but are not limited to, heavy oils, cooking fluids, and other viscous, semi-viscous, or non-viscous fluids. Specific examples of types of content than can be transported and stored in the containers include, but are not limited to, injection molded plastic parts, pharmaceuticals, personal hygiene components, and food products.

The present application provides a simple apparatus and method for reusable collapsible semi-bulk containers.

Figure 1:
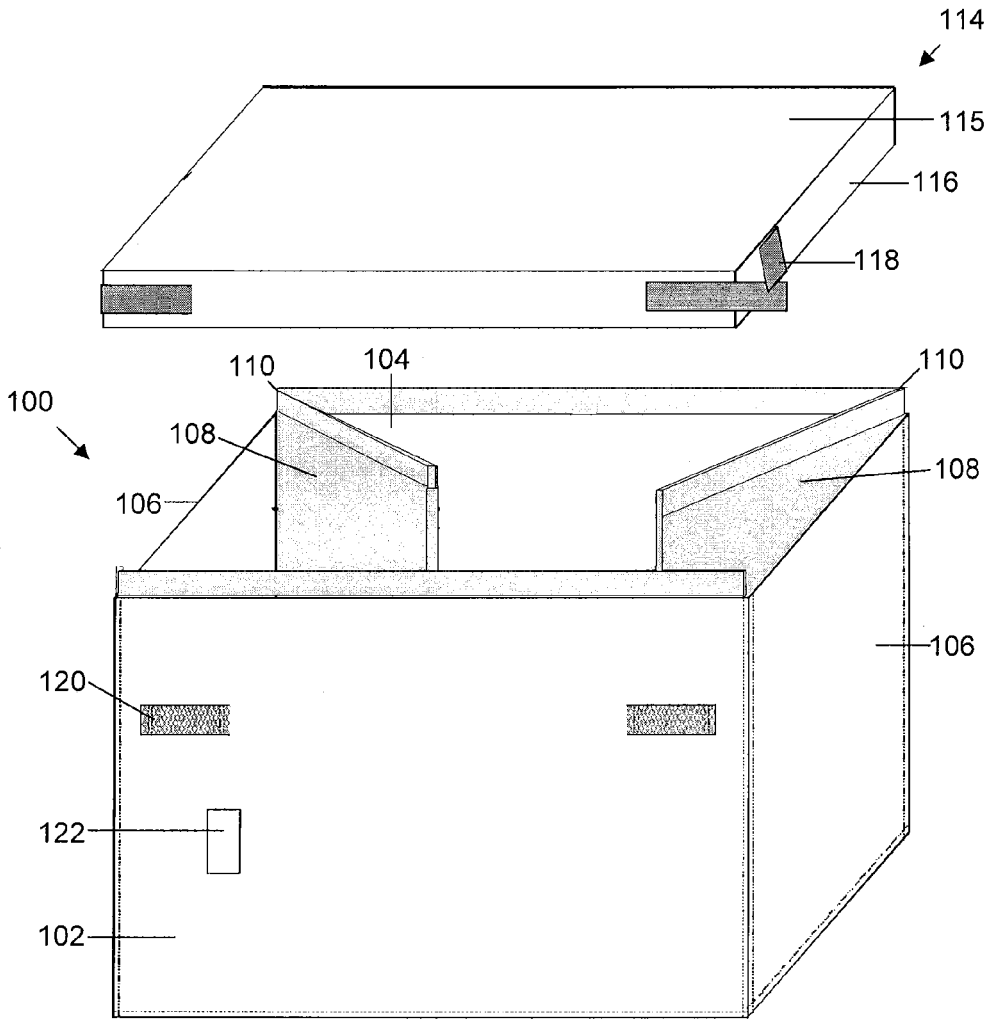
FIG. 1 shows a perspective view of a collapsible semi-bulk container and lid in one aspect of the present invention.

FIG. 1 is a perspective view of a collapsible semi-bulk container 100 in one aspect of the present invention. The container includes four wall panels connected end to end to define four corners, the four wall panels consisting of a front wall 102, a back wall 104, and opposing side walls 106. The four wall panels connect to form a square or rectangular-shaped box. In an embodiment, the containers are produced in base dimensions from as small as 10 inches by 10 inches to as large as 48 inches by 96 inches. In some embodiments, the containers have a height from between 5 inches and 200 inches tall, more preferably between 20 inches and 96 inches. The containers, however, may be produced in any size including those sizes designed to fit standard or custom pallet measurements. For example, the containers can be 40×48 inches, 40×40 inches, 42×42 inches, or 48×48 inches in length and width dimensions. In another example, the containers can be sized to correspond to international pallet dimensions, such as 1000×1200 millimeters, 800×1200 millimeters, or 800×600 millimeters. In one embodiment, the container is designed to be less in each length and width dimension than the pallet, e.g., about one inch less, so that the container can be easily placed on the pallet and expand to the pallet's edges when filled.

The containers are constructed of materials such as woven polypropylene, polyethylene, PVC vinyl, urethane vinyl, or any other fabric or film of appropriate strength. For example, woven polypropylene fabric having a weight of between 3 to 10 ounces per square yard or 6-35 mil film, preferably between 4 to 8 ounces per square yard, and most preferably of about 6.5 ounces per square yard can be used to construct the containers.

In one embodiment, a wall panel is a single sheet of fabric or film. This type of wall panel has no rigidity. The single sheet of fabric may bulge when the container is filled. In an embodiment, the single sheet of fabric is under pressure by being stretched from the corners when the container is erected. Advantageously, wall panels that are manufactured from a single sheet of fabric are flexible and can be folded inward easily when the container is collapsed.

In another embodiment, the container is constructed by sewing two layers of woven polypropylene or woven polyethylene fabric together to create a wall panel having a pocket between the layers. In another embodiment, the wall panels are welded together to eliminate needle holes and create the pocket. Advantageously, welding provides a sealed environment in the container suitable to meet sterile and/or food storage standards. The material can be welded together by any type of welding including hot gas welding, freehand welding, speed tip welding, extrusion welding, contact welding, hot plate welding, high frequency welding, ultrasonic welding, friction welding, laser welding, and solvent welding.

The pockets in the wall panels are designed to receive panels that provide rigidity and support to the container. Each wall can have a single pocket or multiple pockets. If the wall is designed with multiple pockets, each pocket can be defined by a sewn or welded seam. In one embodiment, the pockets have the panels placed therein and are then sealed shut (e.g., sewn or welded shut) to prevent the panel from falling out. In another embodiment, the pockets are open at one end or are reversibly sealable, such as by VELCRO®, a zipper, or other attachment means. Pockets that open allow the panels to be easily removed for transport or replacement.

The rigid panels can be made of plastic, engineered wood product, corrugated paperboard, or other suitable materials. The plastic can be corrugated or flat. Corrugated plastic can be between 4 mil and 25 mil thick, preferably between 10 mil and 16 mil thick, most preferably about 13 mil thick. Optionally, plywood can be from ⅛ inch thick to 2 inches thick, preferably from ¼ inch thick to 1 inch thick, most preferably about ½ inch thick. Additionally, different weight panels can be used for different parts of the container. For example, the panels in the front wall and back wall can be ½ inch plywood while the panels in the opposing side walls can be 13 mil corrugated plastic such as Interpro™.

Figure 2:
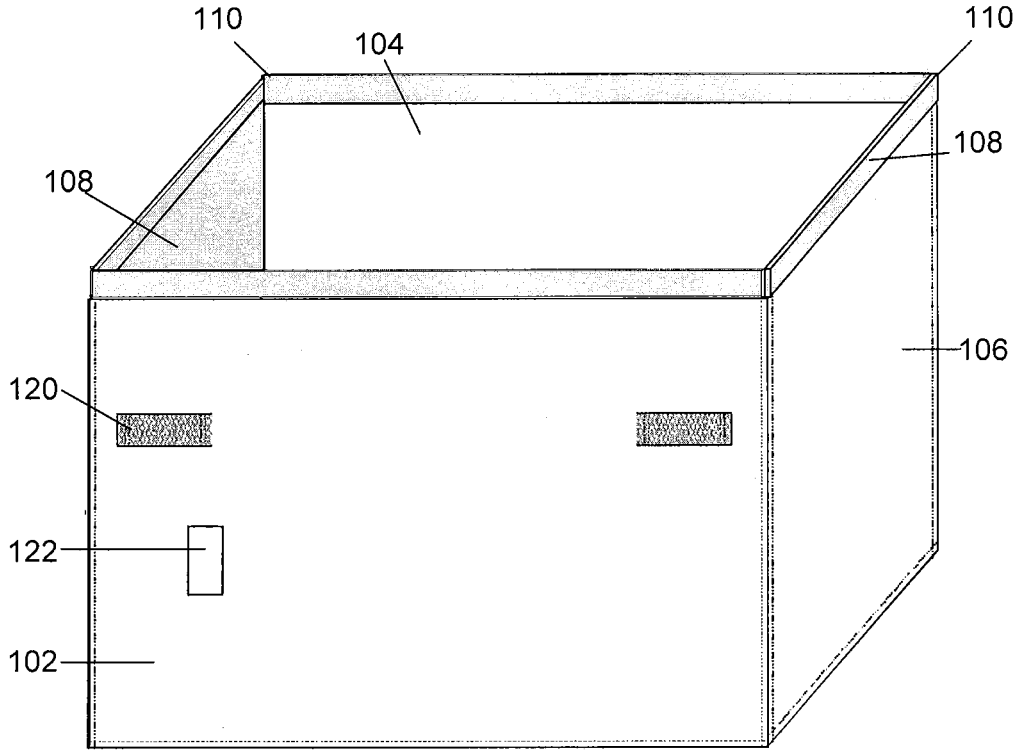
FIG. 2 shows a perspective view of a collapsible semi-bulk container when the swing walls are substantially adjacent the opposing side walls according to one embodiment.
Figure 3:
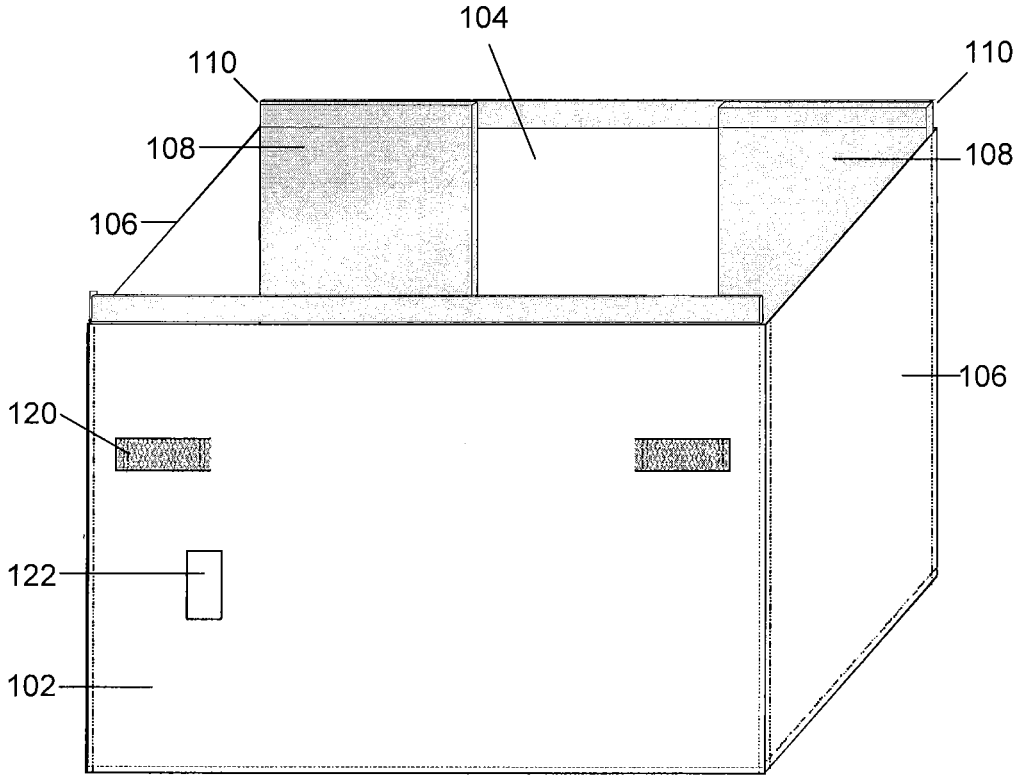
FIG. 3 shows a perspective view of a collapsible semi-bulk container when the swing walls are substantially adjacent the back wall according to one embodiment.

In an exemplary embodiment of the container depicted in FIGS. 1-3, the front wall 102 and the back wall 104 have a single pocket and the opposing side walls 106 are single sheets of fabric. It should be understood that many variations of rigid wall panels and flexible wall panels are possible by combining wall panels that have a pocket for receiving a rigid panel and wall panels composed of a single sheet of fabric.

In the embodiment depicted in FIGS. 1-3, the container includes two swing walls 108. An end of each swing wall is attached to a corner 110 between the back wall 104 and the opposing side walls 106. The swing walls 108 are constructed of similar material and have pockets constructed in a similar manner as the exterior wall panels of the container. A rigid panel can be placed in the swing wall pockets to provide support to the swing walls 108. The swing walls are designed so that they are movable between a first position substantially adjacent to the back wall and a second position substantially adjacent to the opposing side walls. As used herein, the term "substantially adjacent" means positioned next to and contacting or coming close to contacting.

In the embodiment depicted in FIG. 2, the swing walls 108 are sized to extend the length of the opposing side walls 106 when the swing walls 108 are substantially adjacent to the opposing side walls 106. VELCRO® or other attachment means (not shown) may be placed on the opposing side walls 106, the back wall 104, and/or the swing walls 108 to reversibly secure the swing walls 108 in the first position or the second position. When the swing walls 108 are substantially adjacent to the opposing side walls 106, the container is freestanding, able to receive content, supports stacking, and is able to be box dumped without collapsing.

Figure 4:
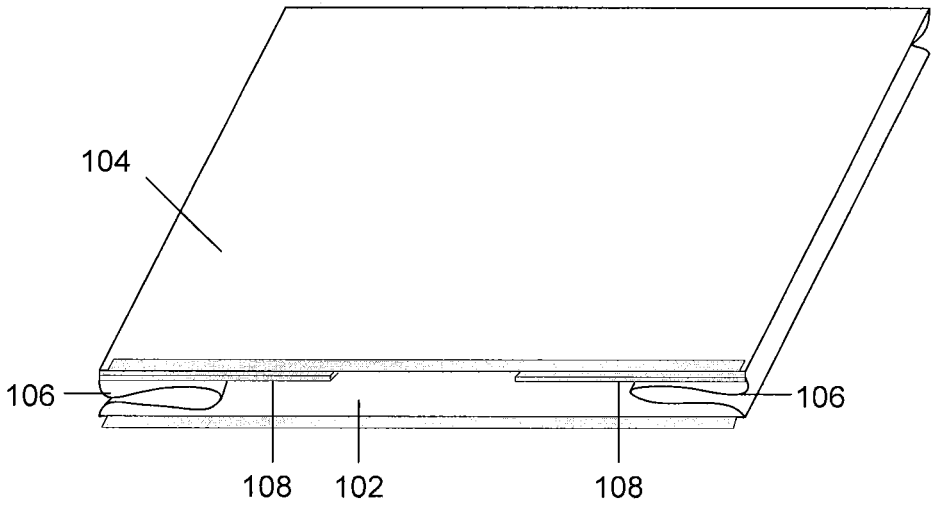
FIG. 4 shows a perspective view of a collapsed semi-bulk container according to one embodiment.

In another embodiment depicted in FIG. 3, the swing walls 108 are substantially adjacent to the back wall 104 and the container may be collapsed. In an embodiment, the opposing side walls do not have panels and the container is only freestanding when the swing walls are located substantially adjacent to the side walls. As shown in FIG. 4, when the swing walls 108 are substantially adjacent to the back wall 104, the container can be collapsed so that the opposing side walls 106 fold in and are contained with the swing walls 108 between the back wall 104 and the front wall 102.

Figure 26:
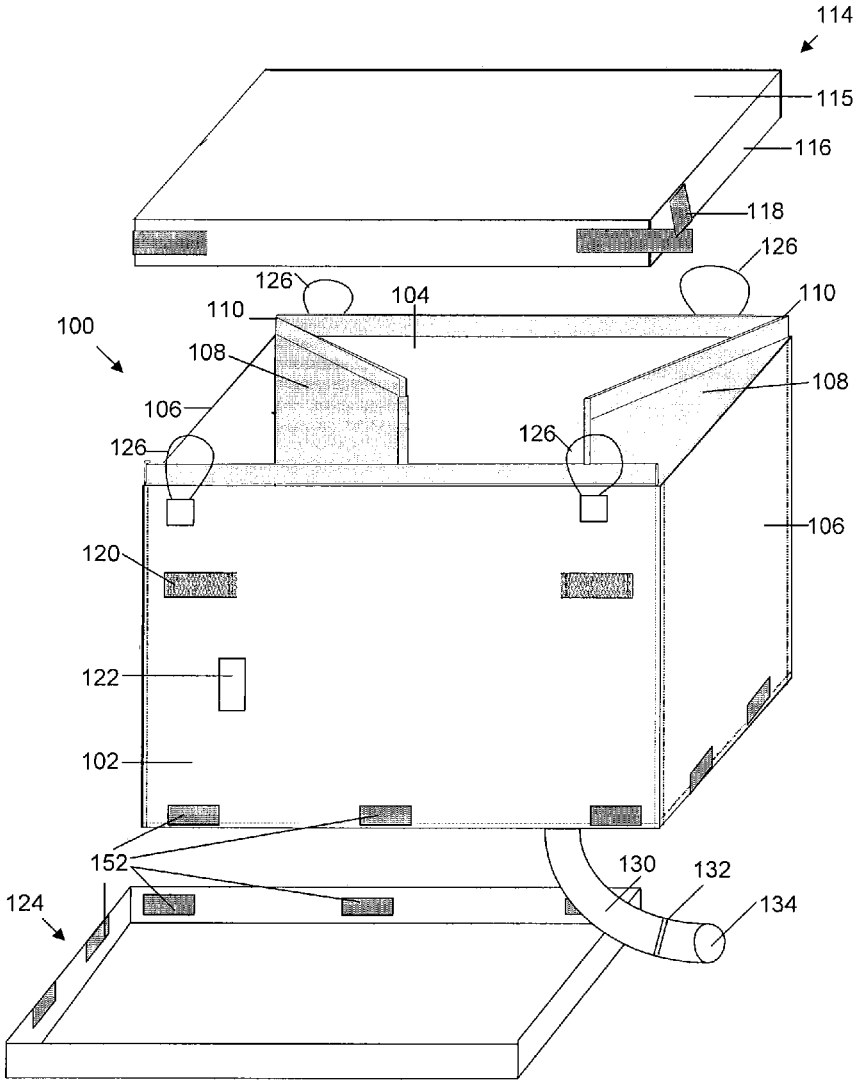
FIG. 26 shows a perspective view of a collapsible semi-bulk container formed with a bottom spout.

In some embodiments, the container also includes a bottom portion (not shown). The bottom portion can be a single piece of fabric or material, as defined herein, attached to the bottom edge of the wall panels. The bottom portion prevents contents of the containers from spilling out of the bottom of the container. In some embodiments, the bottom portion can be made with a bottom discharge spout 130 (See FIG. 26). The bottom discharge spout 130 can be made of flexible material that folds up underneath the container 100 when the container is on a surface, such as a pallet. The bottom discharge spout 130 expels contents of the container from the bottom of the container when the container is lifted using straps 126. The bottom discharge spout 130 can be made with a large or small diameter to increase or decrease the rate of discharge through an opening 134 at the end of the spout. Further, the bottom discharge spout 130 may include a clip 132 that prevents contents from discharging through opening 134. When the clip 132 is on the bottom discharge spout 130, the spout is closed and the container can be lifted without contents coming out of the spout. When the user desires to expel contents from the container, the user can remove the clip 132 and allow the contents to discharge. The bottom discharge spout 130 assists users in emptying large and/or heavy containers that would be time and labor-intensive to empty by hand.

In an embodiment, the bottom portion is not rigid and the bottom of the container is physically supported by resting on a rigid surface. For example, a removable base portion 124, similar to the lid 114, can be included for supporting the bottom of the container. The removable base portion may be attached to the container by VELCRO® or other attachment devices 152. In another example, the container rests on a pallet.

In another embodiment, a cassette 612 (shown in FIG. 23) can be positioned in the container to provide rigid support for the flexible bottom portion. In this embodiment, the container can be used with or without a pallet because the bottom of the container is already supported and will not flex or bulge when the container is filled. For example, a container with a cassette supporting the bottom portion can be pushed or pulled off of a pallet and onto a truck, rail car, or ocean container. The cassette 612 also allows the container to retain its shape when the container is tipped over and the contents are poured out.

Figure 25:
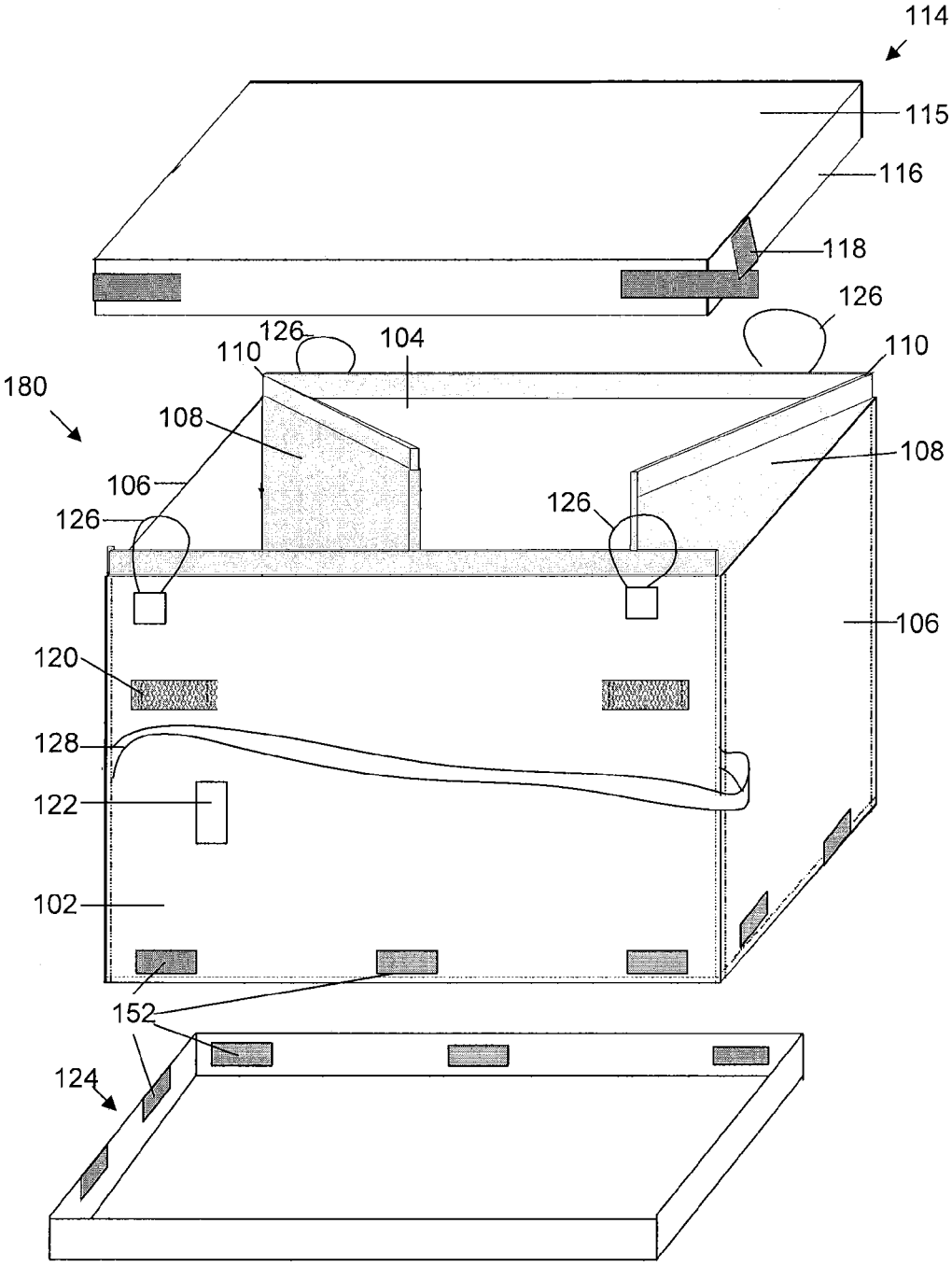
FIG. 25 shows a perspective view of a collapsible semi-bulk container formed from a removable top, a removable bottom, and a collapsible sleeve.

In another embodiment, the container does not include a bottom portion. Instead, the container is formed of a lid 114, a removable base portion 124, and a sleeve 180 formed of four walls 102, 104, 106, 106, as depicted in FIG. 25. The container is formed when the sleeve is erected, either through swing walls 108 or V-fold walls (not shown in FIG. 25), and placed on the removable base portion 124. In an embodiment, attachment devices 152 such as VELCRO® attach the sleeve 180 to the removable base portion 124. When the container is formed, the user may fill the container with contents. The lid 114 may be placed on the container to allow stacking and to protect the contents of the container. After being placed into the container, some content will form up into a solid or semi-solid mass. In this situation, the container can be lifted off of the contents by using straps to lift the sleeve upwards. In another example, a liner is placed within the container and when the container reaches its destination, the sleeve 180 is lifted up using the straps 126. This leaves the contents in the liner at the destination while allowing the sleeve 180 to be reused.

The cassette 612 is constructed from two layers of material creating a pocket and a rigid panel is inserted into the pocket, as described herein. In one embodiment, the rigid panel is sewn into the pocket and in another embodiment the pocket is reversibly sealed by VELCRO® or the like. The cassette 612 can be separate from the container or can be attached to the container at one edge. If the cassette is separate from the container, it is placed in the container after the container is erected and removed from the container when the container is going to be collapsed. If the cassette is attached to the container, it is sewn or welded to a lower edge of one of the wall panels so that it can be folded up to a position substantially adjacent to the front wall 102 or the back wall 104. When the container is collapsed the cassette is in the same plane as the front wall and back wall. The cassette 612 can be located on the inside or the outside of the container. When the cassette is located on the inside of the container, it swings approximately 90 degrees from being substantially adjacent to the inside of the bottom portion to being substantially adjacent to the inside of one of the wall panels. When the cassette is located on the outside of the container, it swings approximately 270 degrees from being substantially adjacent to the outside of the bottom portion to being substantially adjacent to the outside of one of the wall panels.

In some embodiments, the cassette includes a lanyard 614 (shown in FIG. 23) for ease of movement. For example, the cassette may include a 0.5 inch to 2 inch wide strip of webbing sewn to the free end of the cassette. This webbing can be made into a handle so that it is easier to move the cassette to various positions within the container.

Figure 6:
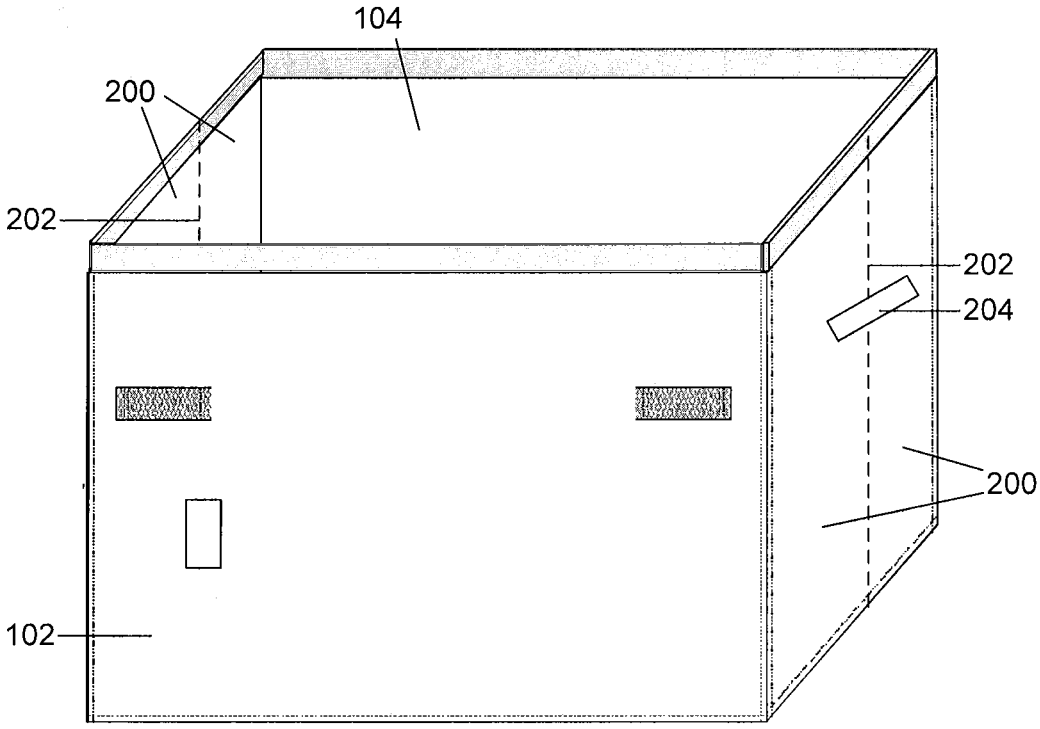
FIG. 6 shows a perspective view of a collapsible semi-bulk container when the side walls are configured as V-fold walls according to one embodiment.

In another embodiment, the bottom portion is constructed of two pieces of material sewn or welded together and having at least one pocket between the two pieces of material. For example, the bottom portion may include a seam down the middle and two panels in the pockets defined on either side of the seam. In this example, the bottom can provide support when open and allow the container to collapse when folded up. Additionally, the bottom portion can have a tab or device 204 that prevents the two panels from expanding outward but allows the panels to be collapsed into the center of the container. The device 204 can best be seen in an analogous structure depicted in FIG. 6. Rather than being on the bottom portion, the device 204 is attached to the opposing side walls 106 in FIG. 6. The principle of operation is the same when applied to the bottom portion and the opposing side walls. The device allows the container to be lifted without the bottom portion of the container sagging.

It should be understood that the various embodiments of the bottom portions described herein are not limiting and can be placed on any of the containers.

In FIG. 1, the container includes a lid 114. In some embodiments, the lid is separate from the container 100 and includes a cap portion 115 and a lip portion 116. In some embodiments, the cap portion 115 is constructed of two layers of material sewn or welded together to create a pocket for holding a square or rectangular-shaped panel, as described herein. The panel can be sewn or welded into the pocket or the pocket can be reversibly sealed using VELCRO® or the like. Alternatively, the cap portion 115 can be constructed of a single layer of fabric. The lip portion 116 extends around the entire circumference of the lid 114 in some embodiments. Again, the lip portion 116 can be a single layer of fabric or two pieces of fabric defining a pocket for receiving a panel. In some embodiments, the lip portion 116 is 4 to 8 inches in length. In still further embodiments, the lid 114 includes attachment means 118 including but not limited to four to eight webbing straps with D rings, pinch clips, pressure lock buckles, or VELCRO® to hold the lid 114 in place for safe stacking and to keep the top covered.

In an embodiment, the lid 114 is constructed with a larger x and y dimension than an unfilled container so that when the container is filled, the sides of the container expand to meet the lip portion 116 of the lid. Optionally, bin handles 120 or loops are sewn to the container so that they align with webbing straps on the rim of the lid. The bin handles 120 allow the container to be lifted from the sides rather than from the bottom edges. The bin handles 120 can also be attached to the webbing straps on the rim of the lid to secure the lid to the container.

Figure 5:
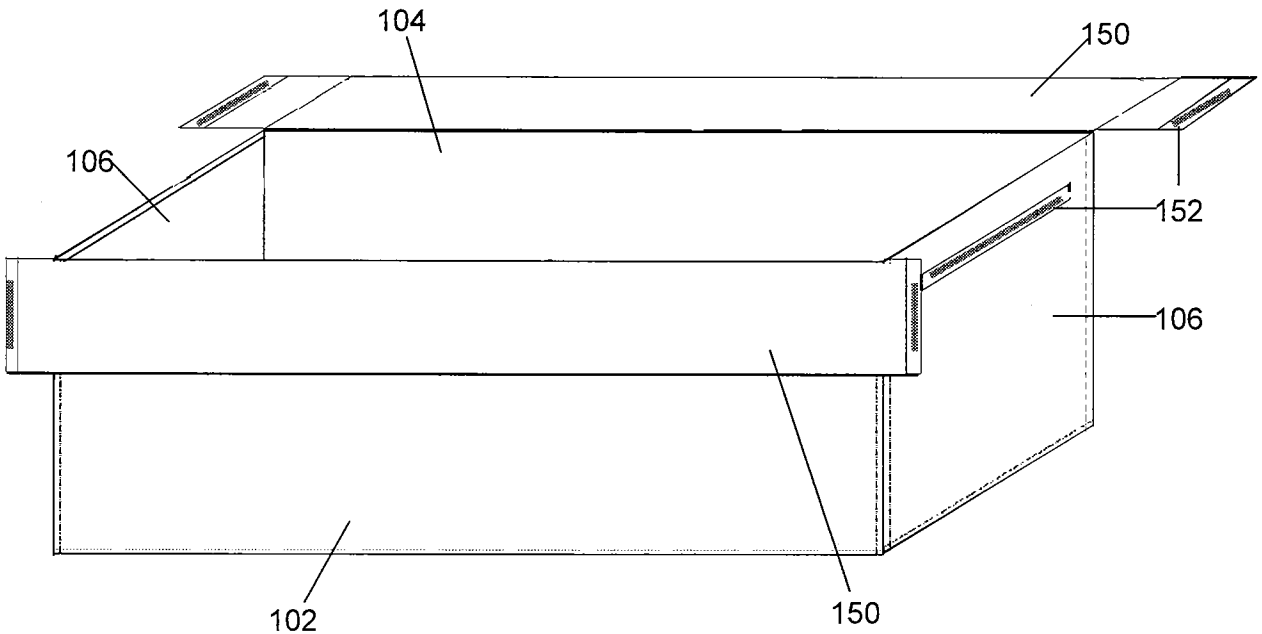
FIG. 5 shows a perspective view of a collapsible semi-bulk container depicting another embodiment of the lid.

FIG. 5 depicts another embodiment of the lid, wherein the lid is attached to the wall panels of the container rather than being unattached to the container. The lid is constructed from two lid flaps 150 that are connected to the top of two opposing wall panels. In this example, the lid flaps 150 are attached to the top of the front wall 102 and the back wall 104. However, the lid flaps 150 can be attached to the opposing side walls 106 as well. In an embodiment, the lid flaps 150 are constructed of two layers of material sewn or welded together to create a pocket for receiving a square or rectangular-shaped panel, as described herein. When the lid flaps 150 are folded up and positioned substantially parallel with the bottom, they act as a lid by enclosing the cavity created by the four wall panels. When the lid flaps 150 are folded down and positioned substantially adjacent with the front wall 102 and the back wall 104, the container can be collapsed for easy storage. In one embodiment, the lid flaps include VELCRO® or similar attachment devices 152 for securing the container in a sealed position. For example, VELCRO® on the margins of each of the lid flaps 150 allows the lid flaps to attach to the container and protect the contents of the container from contamination. In another embodiment, the lid flaps 150 include VELCRO® or similar attachment devices 152 for securing the container in a collapsed position. For example, when the container is collapsed the lid flaps 150 can wrap around the collapsed container and by means of VELCRO® or the like secure the container so that it will not open up accidentally. Turning briefly to FIG. 25, another embodiment of a device to secure the container in a collapsed position is also provided. An elastic band 128, such as a bungee cord, is attached to the opposing edges of the front and/or back wall 102, 104. After the container is collapsed into a flat position, the elastic band 128 is stretched over the top or bottom of the container and around to the other side. This compresses the front and back wall 102, 104 against each other so that the container cannot open without the elastic band 128 being removed from around both walls. Securing the container in various positions assists in transport of the container.

It should be understood that the containers described herein can include any of the lid features described herein. The Figures are for illustration only and do not limit the different container embodiments to the specific lids disclosed therewith.

Figure 7:
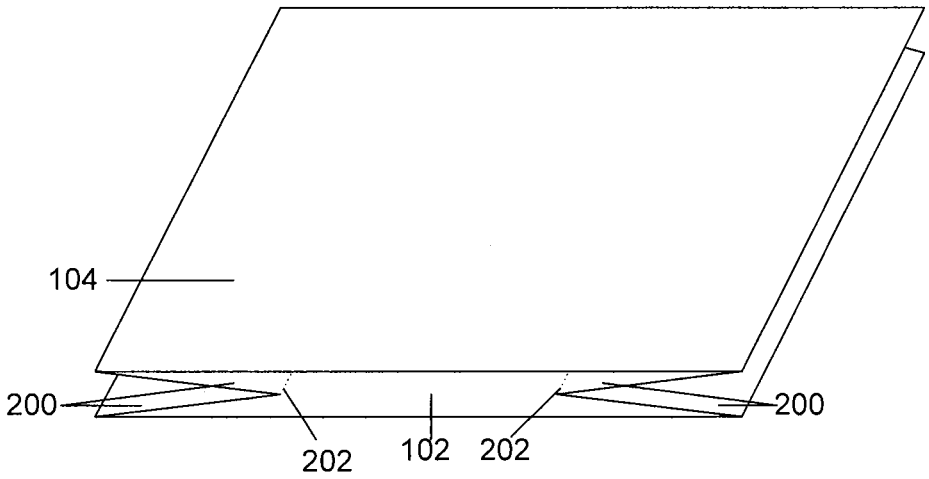
FIG. 7 shows a perspective view of a collapsed semi-bulk container when the side walls are configured as V-fold walls according to one embodiment.

FIGS. 6-9 depict another embodiment wherein the container collapses by having V-fold wall panels 200 on opposite sides of the container. The V-fold wall panels 200 are constructed from two sheets of material sewn or welded together, as described herein. Two rigid panels are enclosed in the V-fold wall panels 200 and separated by a seam 202 running the length of the wall panel. In an embodiment, the V-fold design includes a device 204 that allows the two panels to fold in a single direction. The device 204, such as a tab, may be attached to the exterior wall on either side of the seam. The device 204 allows the panels to fold inward towards the center of the container but prevents the V-fold panels from folding outward. When the V-fold wall panels are extended as in FIG. 6, the rigid panels support the container in an upright position. When the V-fold walls are folded in, however, the container may be collapsed, as depicted in FIG. 7. In a collapsed formation, the V-fold wall panels 200 are angled inward and positioned between the front wall 102 and the back wall 104.

Figure 8:
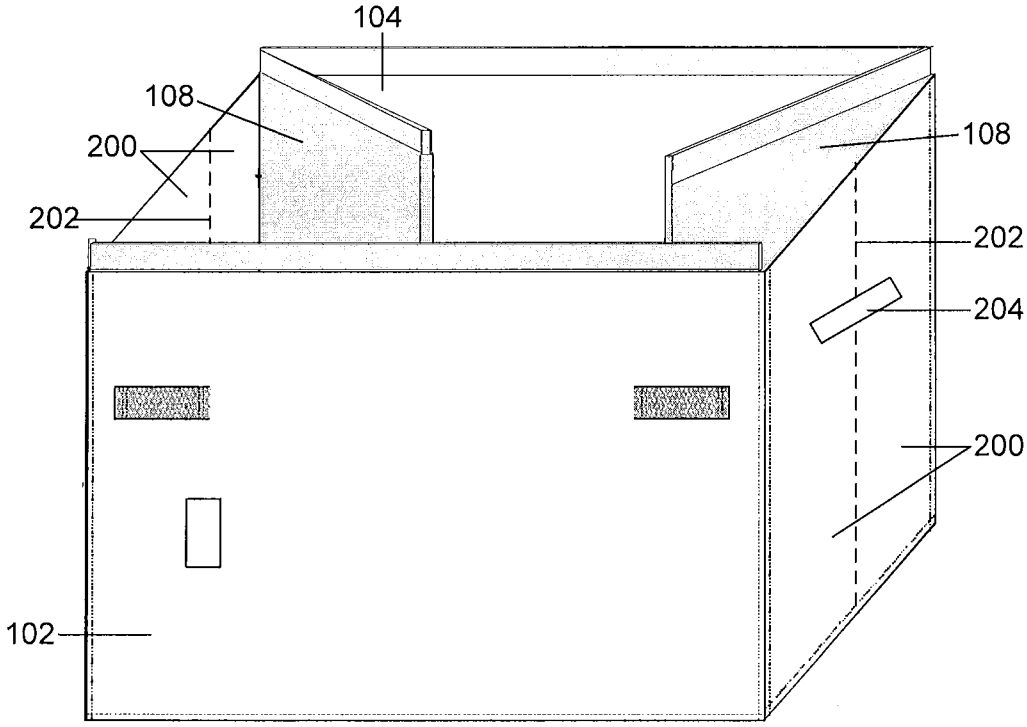
FIG. 8 shows a perspective view of a collapsible semi-bulk container when the side walls are configured as V-fold walls and the container includes swing walls according to one embodiment.
Figure 9:
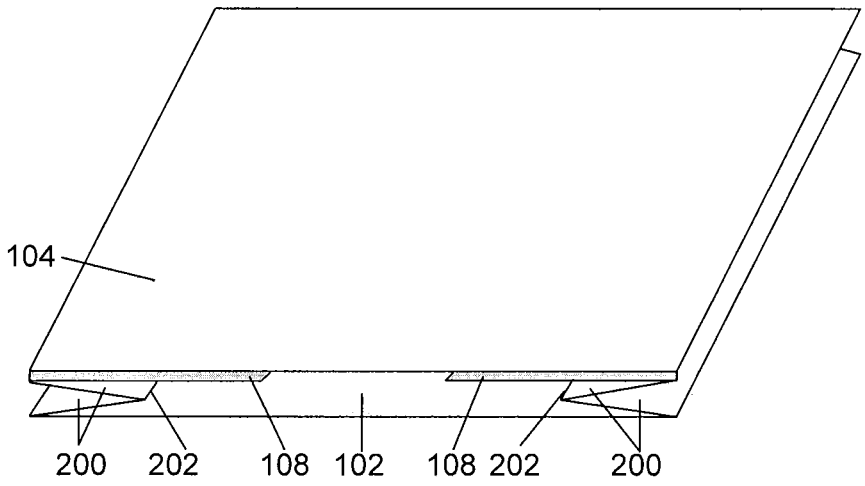
FIG. 9 shows a perspective view of a collapsed semi-bulk container when the side walls are configured as V-fold walls and the container includes swing walls according to one embodiment.

FIG. 8 depicts another embodiment of the container having the V-fold wall panels 200 and further including the swing walls 108. The swing walls 108 are constructed as described herein. The swing walls 108 provide additional support to the wall panels for heavy loads or when the V-fold wall panels 200 do not have the device 204 for preventing outward extension. When the swing walls 108 are positioned substantially adjacent to the V-fold wall panels 200, the container is supported in an upright position. When the swing walls 108 are positioned substantially adjacent to the back wall 104 and the V-fold wall panels 200 are folded inward the container can be collapsed, as depicted in FIG. 9. In the collapsed position, the swing walls 108 and the V-fold wall panels 200 are positioned between the front wall 102 and the back wall 104.

Figure 10:
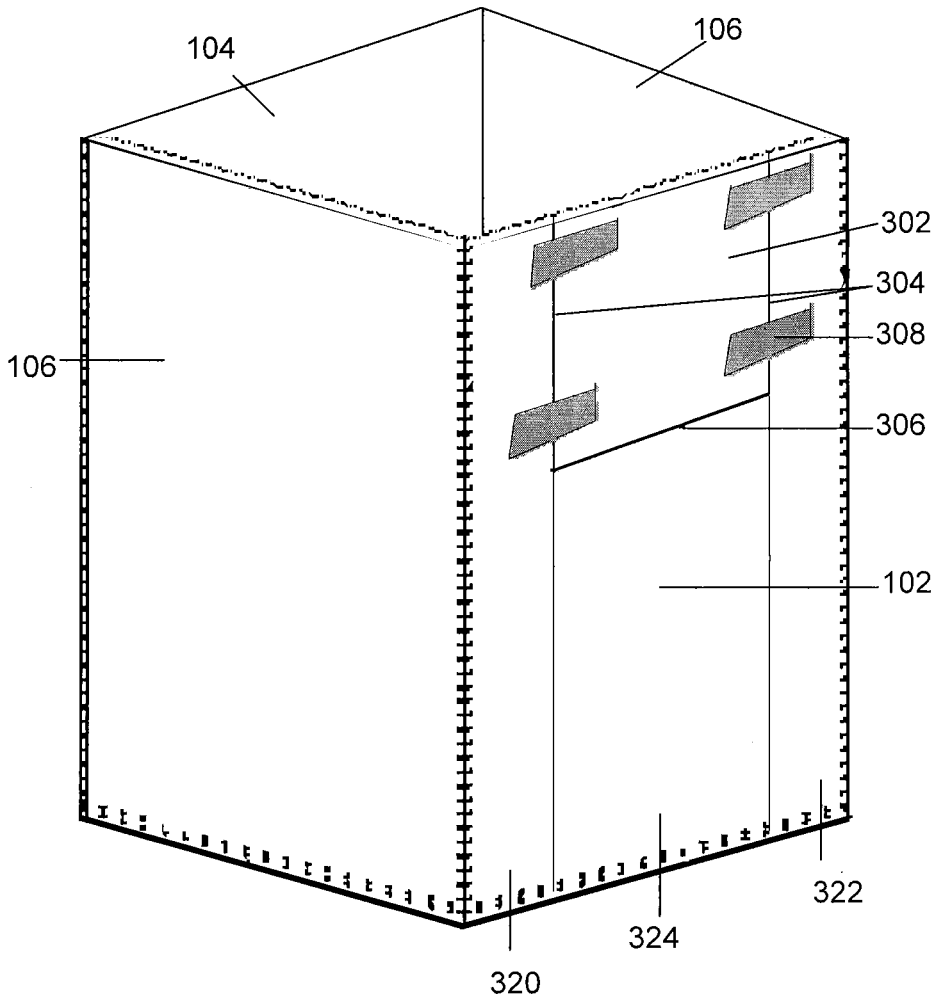
FIG. 10 shows a perspective view of a collapsible semi-bulk container having an access door according to one embodiment.
Figure 11:
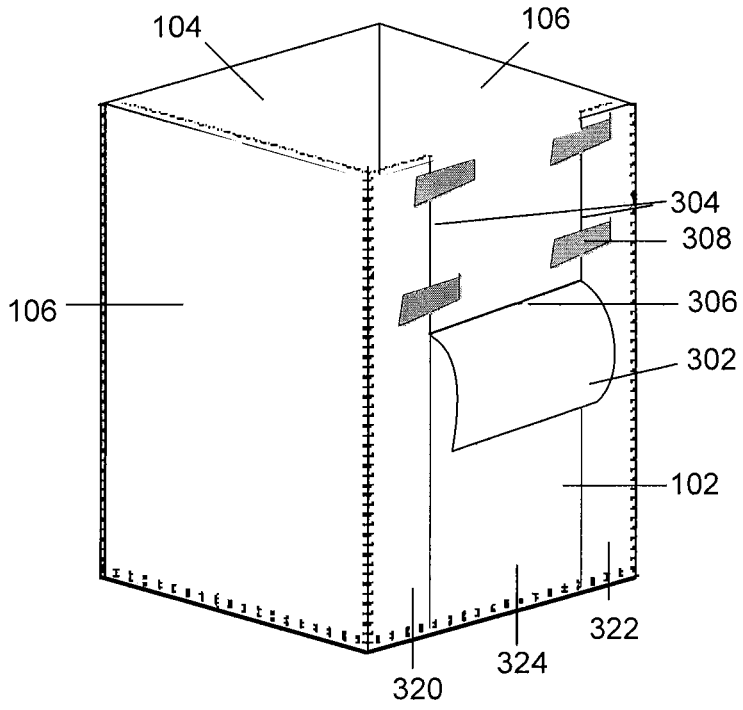
FIG. 11 shows a perspective view of a collapsible semi-bulk container having a fold-down access door according to one embodiment.
Figure 12:
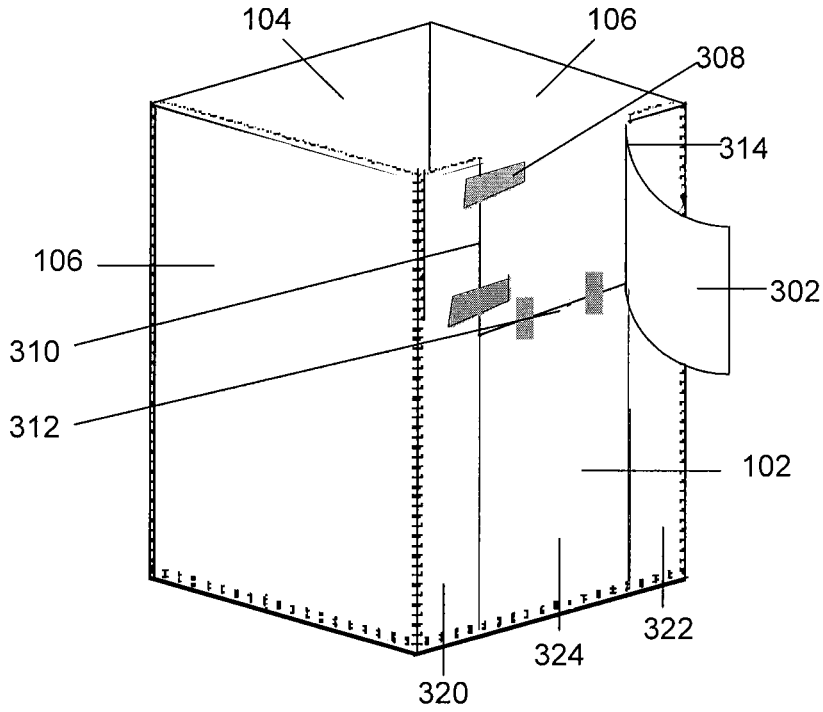
FIG. 12 shows a perspective view of a collapsible semi-bulk container having a fold-to-the-side access door according to one embodiment.

FIGS. 10, 11, and 12 show an access door 302 as it may be configured in any embodiment. The access door 302 can be opened to allow easy access to the interior of the container. For example, the access door 302 in FIG. 10 is in the front wall 102 of the container. The access door 302, however, can be in any one or more of the wall panels of the container. Typically, the access door 302 is of a slightly lower height (e.g., about 1 inch) than the wall panel portions on either side of it so that weight is not supported on the access door 302 when something (e.g., another container) is stacked on top of the container. As shown in FIG. 10, the access door 302 is sealed in a closed position by attachment means 308 such as VELCRO® tabs, zippers, pressure lock buckles, pinch clips, or the like. The access door can be off-centered in the wall. Further, the access door can have any width so long as the wall retains sufficient rigid materials on either side to support containers while stacked up to five high. The access door 302 is manufactured from the same material as the wall panels. In one embodiment, the access door 302 is a single sheet of material. In another embodiment, the access door 302 is two pieces of material sewn or welded together and capable of receiving a rigid panel, as described herein.

In an embodiment shown in FIGS. 10 and 11, the access door 302 is constructed by placing two slits 304 in one of the wall panels and allowing the access door 302 to fold at a seam 306 substantially perpendicular to the two slits. The access door folds at the seam 306 located at some measurement down the wall. In an embodiment, the seam 306 is located above the midpoint of the wall, e.g., about one inch above the midpoint, so that when the access door is folded down it does not reach the bottom of the wall panel. In an embodiment, the access door 302 also defines three other panels in the wall panel: a first panel 320 on one side of the access door 302, a second panel 322 on a second side of the access door 302, and a third panel 324 below the access door 302. The first panel 320, second panel 322, and third panel 324 can be constructed of two sheets of fabric, as described herein, and have rigid panels providing support in them. Alternatively, a single piece of rigid material can be designed for the wall panel having the access door.

In another embodiment shown in FIG. 12, the access door 302 is configured to open to the left or the right. In this embodiment, a slit extending substantially vertically 310 and a slit extending substantially horizontally 312 define a side and bottom edge of the access door 302. A seam 314 defines the opposing edge of the access door. The attachment means 308 are also provided to secure the door in a closed position. The access door 302 that opens to the left or the right can have any height because the access door is not folding down towards the floor but rather to one of the edges where the wall panels meet.

Figure 13:
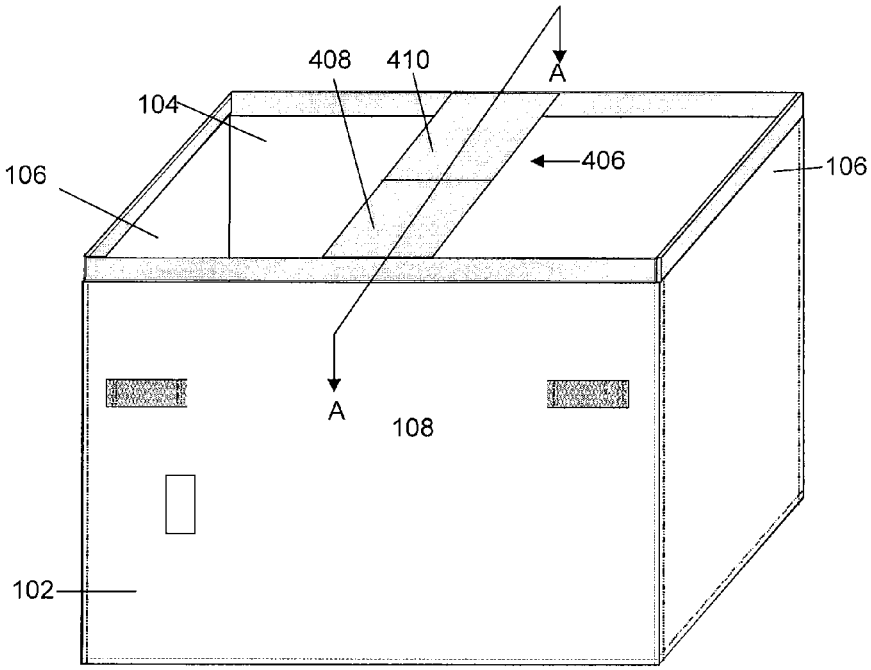
FIGS. 13, 13*a*, and 13*b* show perspective views of a collapsible semi-bulk container having a girdle according to one embodiment.
Figure 13A:
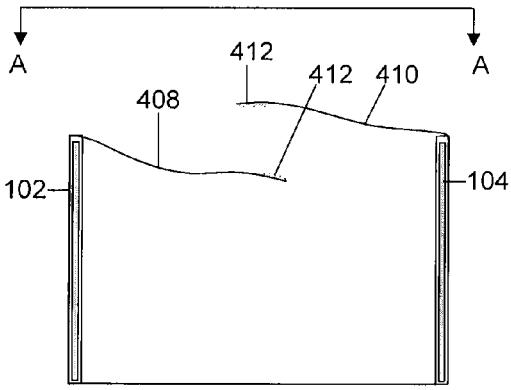
Figure 13B:
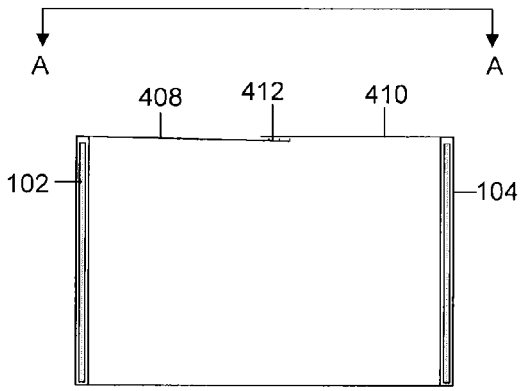

In another embodiment depicted in FIGS. 13, 13*a*, and 13*b*, the container includes at least one girdle 406 configured to reduce deflection in the center of each wall panel. When the container is storing a heavy load, the load presses against the interior walls and causes the wall panels to deflect outwards. The girdle 406 prevents this deflection from happening by providing support to the wall panels. A first piece of material 408 is sewn or welded to a wall panel, as described herein. In an embodiment, a second piece of material 410 is sewn or welded to the opposing wall. The two pieces of material reversibly attach to one another by attachment means 412 and provide support to both wall panels. For example, the first piece of material 408 may be sewn to the front wall 102 and include VELCRO® at one end. The second piece of material 410 is sewn to the back wall 104 and includes VELCRO® at a matching end. One skilled in the art would know to position the VELCRO® on the pieces of material so that the VELCRO® can secure the two pieces of the girdle, as well as that other types of attachment means may be used. For example, hook and loop, buttons, or adhesives may be used to connect the girdle. The two pieces of material can be any length so long as they are capable of connecting to one another. For example, the two pieces of material may overlap for some distance. Additionally, the two pieces do not need to be the same length and the attachment means do not need to connect at the midpoint of the opening of the container. To provide support to the wall panels, the first piece of material 408 and the second piece of material 410 are stretched towards one another and attached to provide resistance against stretching wall panels. The girdle 406 is reversible by detaching the attachment means 412 so that the container can be easily collapsed. In an embodiment, more than one girdle 406 is provided on the container. For example, two girdles may be included substantially parallel to one another to support a long wall panel. In another example, at least one girdle is attached to the front wall 102 and back wall 104, and at least one girdle is attached to the opposing side walls 106. In this manner, the girdles cross over one another and support the four wall panels.

FIG. 13A depicts a cross-section of the girdle 406 when the first piece of material 408 and the second piece of material 410 are not connected to one another by the attachment means 412. FIG. 13B depicts a cross-section of the girdle 406 when the first piece of material 408 and the second piece of material 410 are connected to one another by the attachment means 412. As can be seen in FIG. 13A, the girdle 406 connects the front wall 102 to the back wall 104 so that interior pressure in the container does not cause the front wall and back wall to bulge outwards.

In another embodiment, the girdle 406 includes a single piece of material having attachment means sewn or welded to a wall and corresponding attachment means attached to the opposing wall. The single piece of material is from one wall panels to an opposing wall panel and connected to the attachment means to prevent the wall panels from deflecting because of weight. The attachment means may be VELCRO®, hook and loop fasteners, zippers, pressure lock buckles, pinch clips, or the like.

In still further embodiments best seen in FIG. 1, the container includes bin handles 120 for use in moving the container. The bin handles 120 can be attached by sewing or welding to the vertical seams or to the outside layer of the walls. In some embodiments, two to four loops made from webbing are sewn into the vertical seams so that the container can be picked up for stacking or to allow discharge of contents. In other embodiments, handles for picking up the empty container when erected or collapsed can be located anywhere on the container and lid. The handles can be sewn or welded onto the material comprising the container.

In some embodiments seen in FIG. 1, the containers include document pockets 122 or placards on the container. The document pockets 122 are sewn or welded onto the container for placing removable material, such as identifying labels, on container. The document pockets 122 can be polyethylene sealable bags or they can be a single sheet attached to the container walls on three sides so that labels can be placed in the pocket created between the sheet and the wall.

In another embodiment, any of the containers described herein can include a liner (not shown) for storage of dry flowable parts. For example, a polyethylene film liner can be included in the container. The liner is easy to clean and allows the contents to be quickly removed from the container. When the container is divided into smaller compartments, multiple liners can be included in each compartment to protect or store the contents therein.

Figure 14:
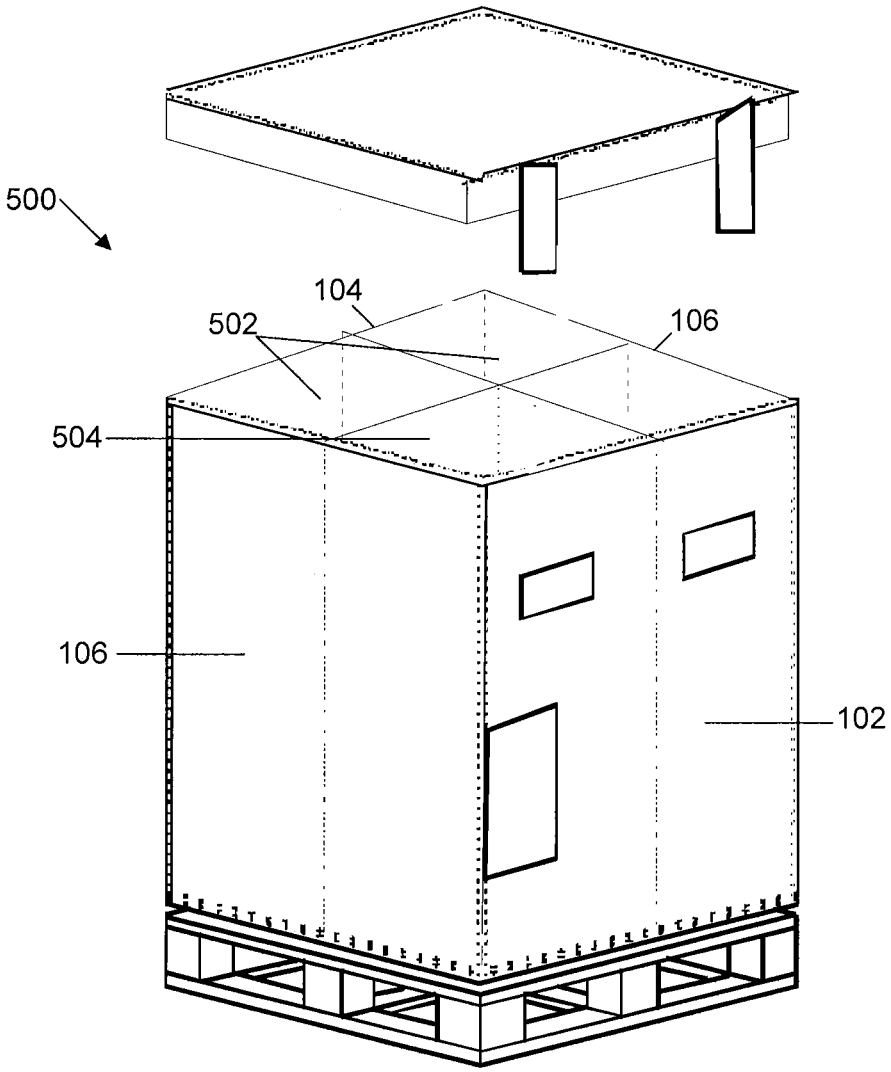
FIG. 14 shows a perspective view of a collapsible semi-bulk container having a fabric baffle according to a second aspect of the invention.

FIGS. 14-20 are views of a collapsible semi-bulk container in a second aspect of the present invention. In FIG. 14, the container 500 is divided into smaller compartments 502 by a fabric baffle 504 attached to the interior walls of the container. For example, the fabric baffle 504 can be sewn or welded to the midpoint of each of the front wall 102, the back wall 104, and the opposing side walls 106 and joined in the center of the container. The fabric baffle 504 is constructed of the material used to manufacture the walls of the container. When the fabric baffle 504 is attached to opposing walls, the fabric baffle has sufficient tension to prevent contents of the compartments 502 from deforming the container. In this manner, the fabric baffle 504 protects the contents of the compartments 502 from static load. The fabric baffle also allows the container 500 to collapse for ease of storage and transport.

Figure 15:
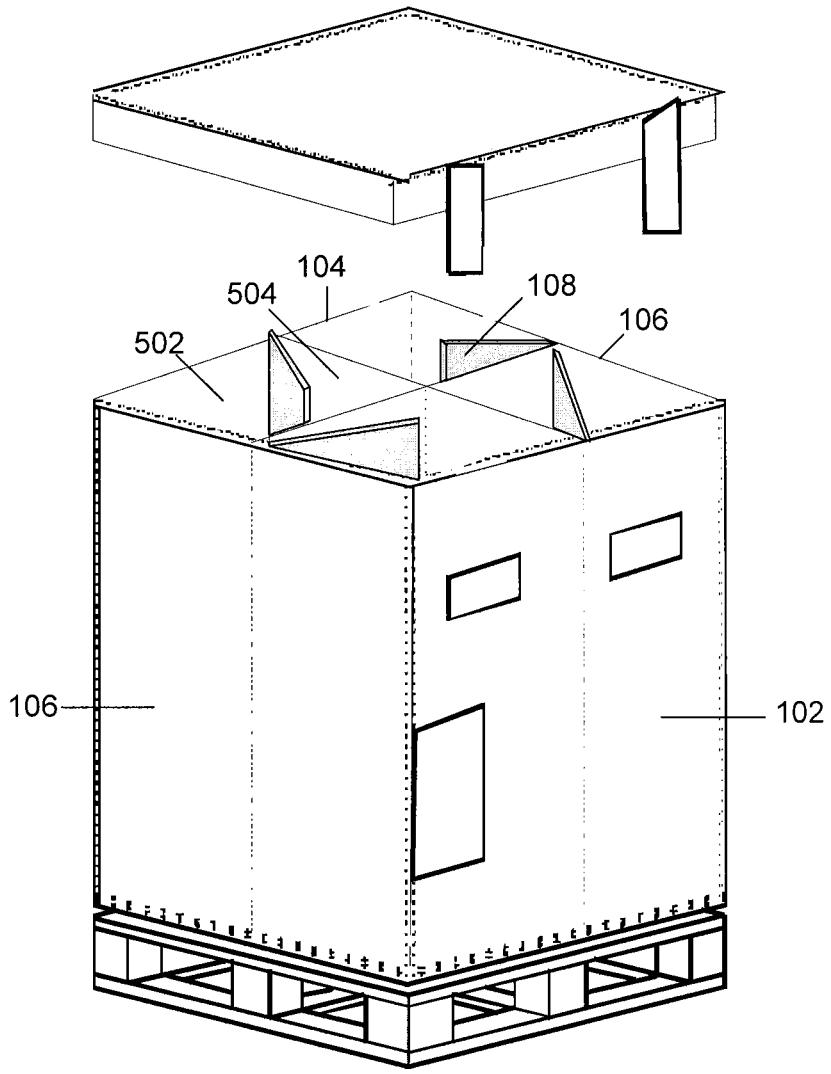
FIGS. 15, 16, and 17 show perspective views of collapsible semi-bulk containers having a fabric baffle and swing walls according to one embodiment.
Figure 16:
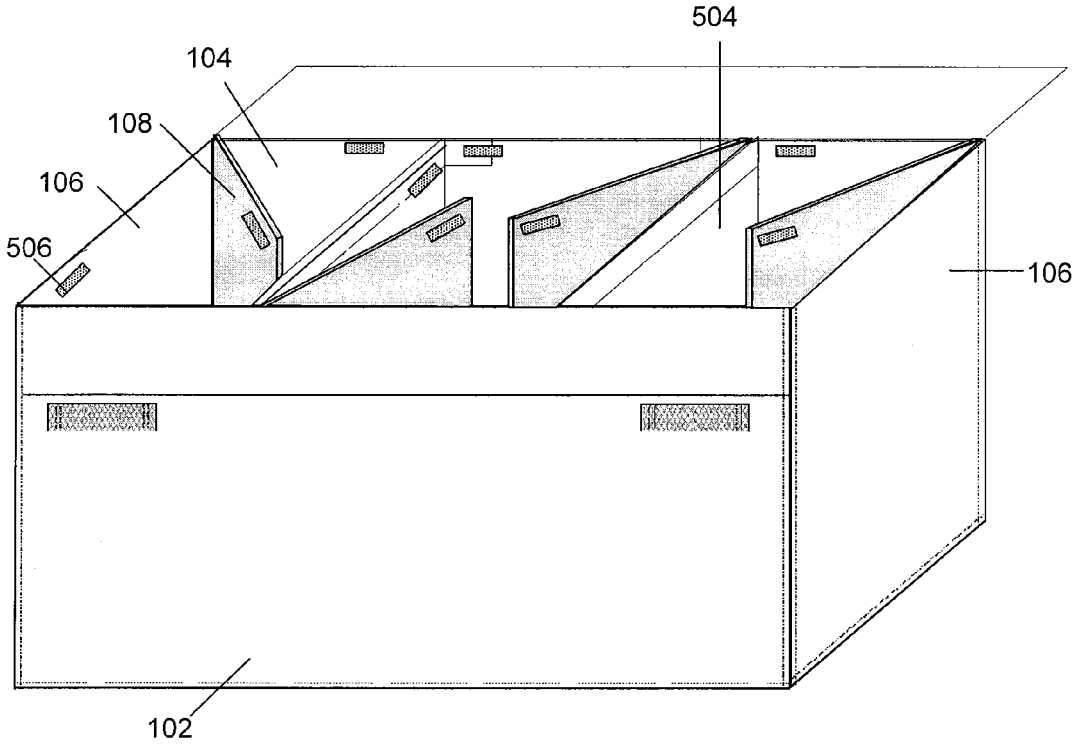
Figure 17:
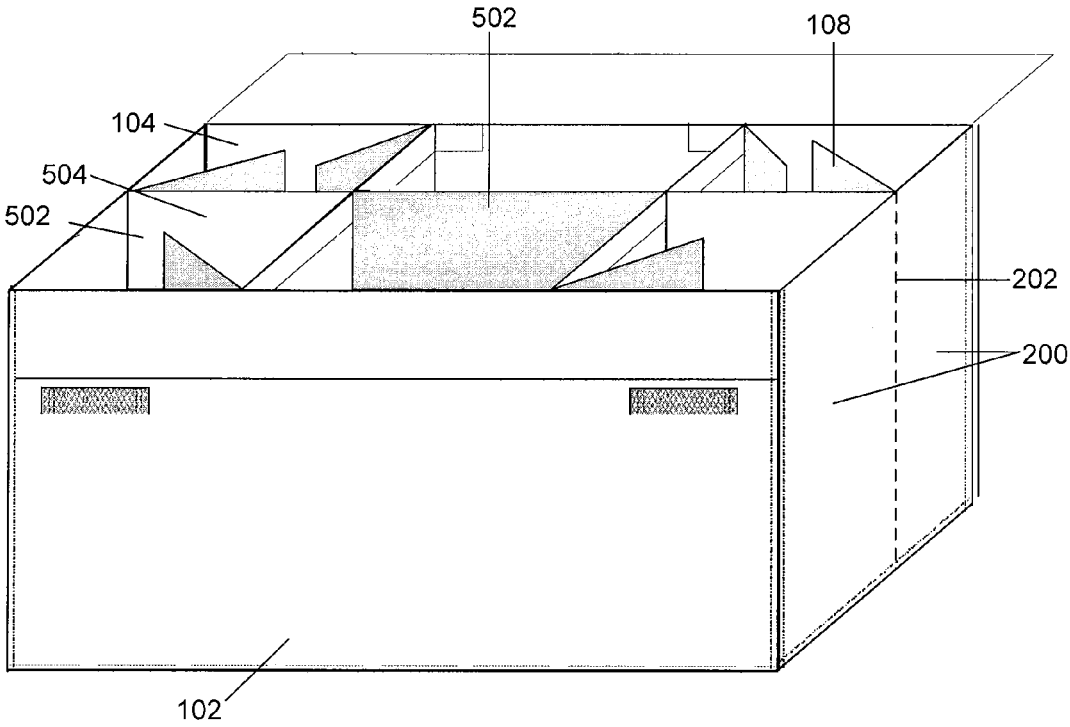

In embodiments depicted in FIGS. 15-17, the swing walls 108 are attached to the interior walls of the container 500 to provide rigid support to the fabric baffles 504, as described herein. The swing walls 108 can be moved between being substantially adjacent to the walls of the container and substantially adjacent to the fabric baffles 504. Optionally, attachment means 506 such as VELCRO® may be used to secure the swing walls 108 in place against the front wall 102, the back wall 104, the opposing side walls 106 and/or the fabric baffles 504 (best seen in FIG. 16). When the swing walls 108 are positioned substantially adjacent to the fabric baffles 504, the rigid support of the swing walls 108 protects the contents of the container from dynamic load. When the swing walls 108 are positioned substantially adjacent to the container walls, the container may be collapsed for ease of storage and transport. In a still further embodiment, the swing walls are connected to the fabric baffles 504 instead of being attached to the container walls. In this embodiment, the container is still able to be collapsed when the swing walls are oriented so that all rigid surfaces are in the same plane.

The fabric baffles 504 of the container may be configured in a variety of formats as depicted in FIGS. 15-17. For example, the fabric baffles 504 may be positioned in a single plane in the interior of the container as depicted in FIG. 16. Multiple baffles may divide the container into smaller compartments 502. The fabric baffles 504 alone protect the contents from static load. Various devices for providing rigidity to the baffles are also contemplated. For example, the fabric baffles 504 may be constructed with an interior pocket for receiving a rigid panel 508. The pocket may be open on the top and allow the rigid panel 508 to be inserted into each pocket when the container is set up. The rigid panel 508 can be removed when the container is collapsed. Alternatively, the swing walls 108 may be attached to the container wall panels, as described herein. As discussed, when the fabric baffles 504 are provided with rigidity, either through the rigid panels 508, the swing walls 108, or similar devices, the contents of the compartments are protected from dynamic load.

The containers depicted in FIGS. 15-17 can have any of the various side wall 106 configurations described herein. FIG. 15 depicts a container have a single sheet of material on the opposing side walls 106. The opposing side walls are hence not rigid but receive support by the fabric baffle 504 attached at the midpoint of each. The pressure from the interior contents in the compartments 502 prevents the opposing side walls from bulging out and deforming the container. In another embodiment depicted in FIG. 16, the container also has opposing side walls 106 constructed of a single piece of material. The opposing side walls 106, however, are supported by the swing walls 108 that can be positioned substantially adjacent to the opposing side walls 106. In a further embodiment depicted in FIG. 17, the opposing side walls 106 are supported by the V-fold wall panels 200 described herein. A seam runs the length of the opposing side walls and allows the V-fold wall panels 200 to fold inward when the container is collapsed. No device 204 is necessary to prevent the V-fold wall panels 200 from extending out from the interior of the container because the fabric baffle 504 restricts movement of the V-fold wall panels 200 in that direction.

Figure 18:
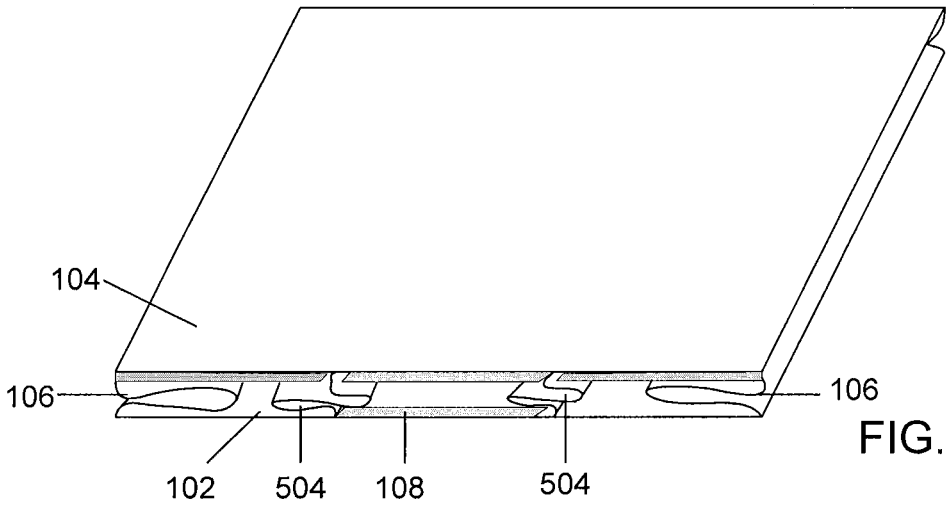
FIGS. 18, 19, and 20 show perspective views of collapsed semi-bulk containers having a fabric baffle and swing walls according to one embodiment.
Figure 19:
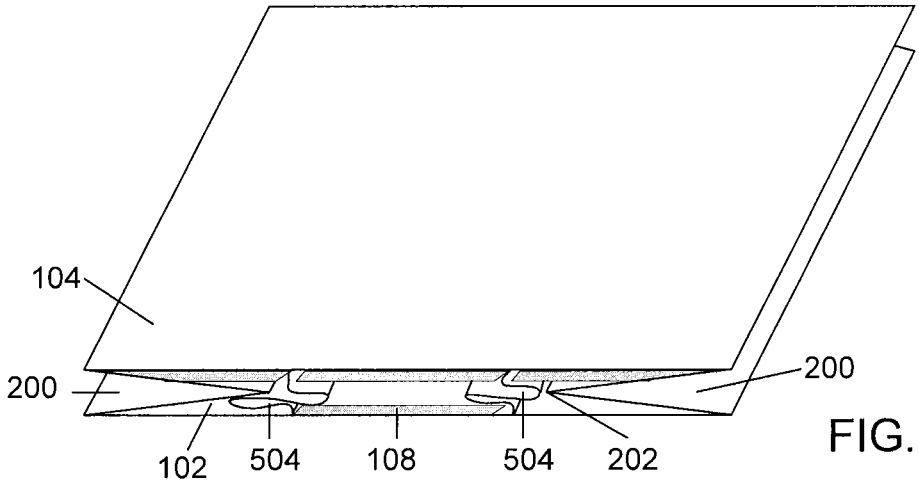
Figure 20:
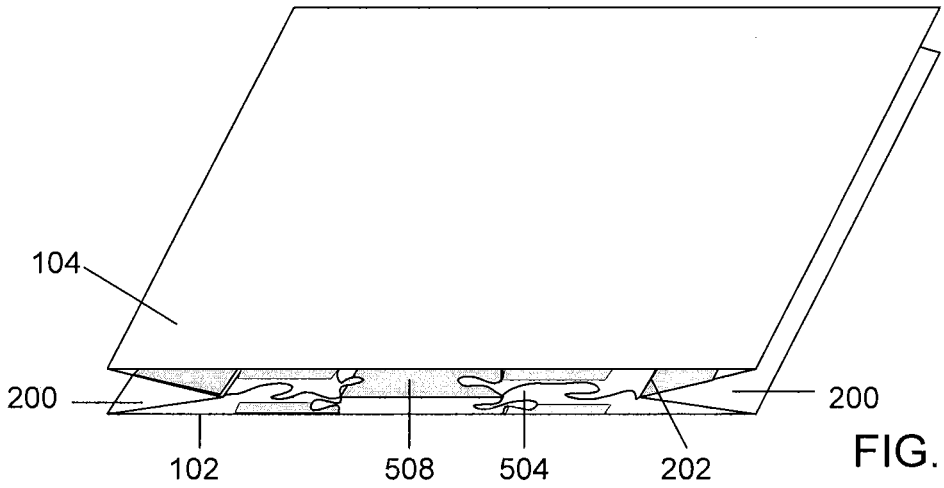

FIG. 18-20 depict various containers having fabric baffles 504 in collapsed positions. FIG. 18 depicts the container of FIG. 16 in a collapsed position. As can be seen, the opposing side walls 106 and the fabric baffles 504 fold inward, and the swing walls 108 are positioned substantially adjacent to the front wall 102 and the back wall 104. The container collapses because the front wall 102, the back wall 104, and the swing walls 108 are all positioned in the same plane and the opposing side walls 106 are flexible and fold inward. FIG. 19 depicts a similar embodiment wherein the opposing side walls 106 are constructed of the V-fold wall panels 200 rather than single sheets of material. The V-fold wall panels 200 fold inward so that the front wall 102 and the back wall 104 can collapse down and compress the fabric baffles 504. The swing walls 108 are again positioned substantially adjacent to the front wall 102 and the back wall 104. Finally, FIG. 20 depicts the container of FIG. 17 in a collapsed position. The fabric baffles 504 are again folded inward. The swing walls 108 are positioned substantially adjacent to the front wall 102 or the back wall 104. The V-fold wall panels 200 are folded inward. Further, the rigid panel 508 can be left in the fabric baffle substantially parallel to the front wall 102 and the back wall 104, as depicted, or the rigid panel can be removed from the fabric baffle so that the entire fabric baffle 504 is flexible.

Figure 21:
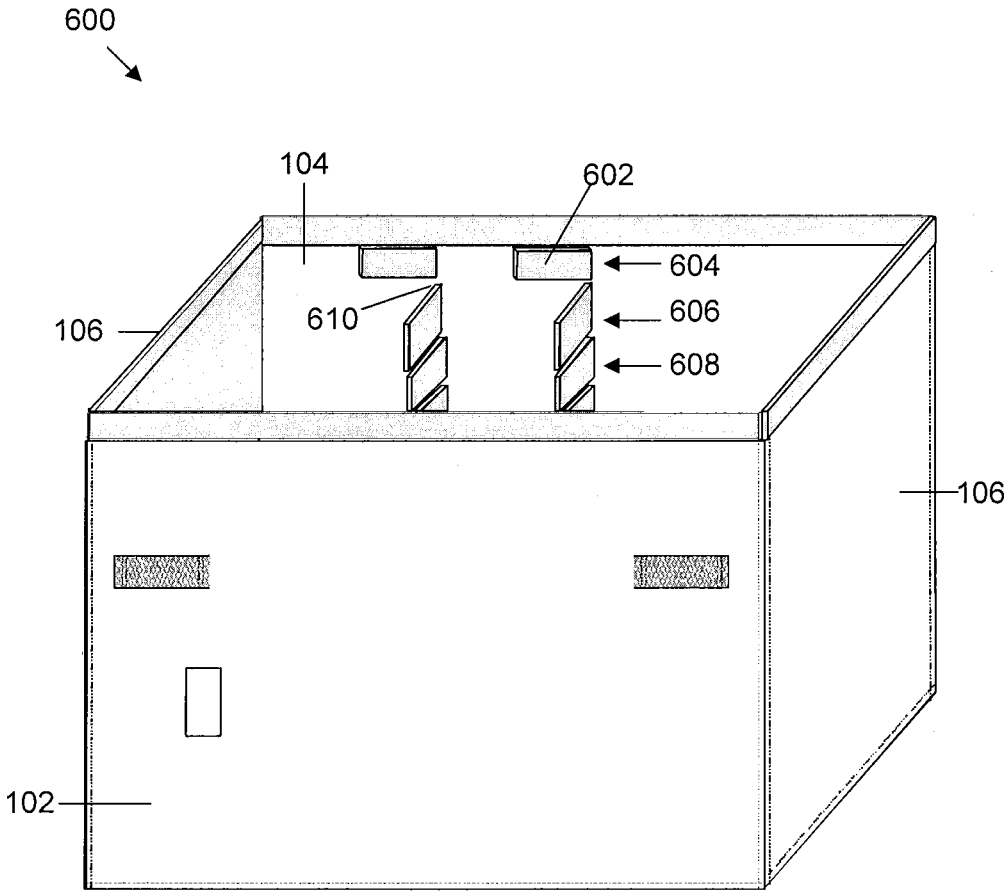
FIG. 21 shows a perspective view of a collapsible semi-bulk container having partial swing walls according to a third aspect of the invention.

FIGS. 21-24 depict various configurations of a third aspect of the invention. FIG. 21 is a perspective view of a container according to the third aspect of the invention. In FIG. 21, the container 600 includes the front wall 102, the back wall 104, and the opposing side walls 106. The container also includes partial swing walls 602 that are movable between a position substantially adjacent the front wall 102 or the back wall 104 and a position substantially perpendicular to the front wall 102 or the back wall 104. As used herein, "substantially perpendicular" means that the partial swing walls are able to be moved to a position plus or minus 10 degrees off of perpendicular to the front wall or back wall. The partial swing walls 602 are constructed of two sheets of material sewn or welded together to define a pocket for receiving a rigid panel, as described herein. The partial swing walls 602 can be attached to the front wall 102, the back wall 104, or the opposing side walls 106 of the container. In an embodiment, multiple layers of partial swing walls 602 can be provided in a container. For example, a first layer 604 can be provided at the opening of the container and a second layer 606, third layer 608, etc., can be provided below each previous layer. In an embodiment, the partial swing walls are sized so that when partial swing walls facing each other on opposing wall panels of the container are positioned pointing into the container, the partial swing walls 602 overlap or come close to meeting. Attachment means (not shown) can be provided on the ends of opposing partial swing walls 602 so that they can be secured to one another in the interior of the container. In a further embodiment, the different layers 604, 606, and 608 of the partial swing walls 602 are spaced on the walls panels such that there is a space 610 between the lower edge of one partial swing wall and the upper edge of another partial swing wall.

Figure 22:
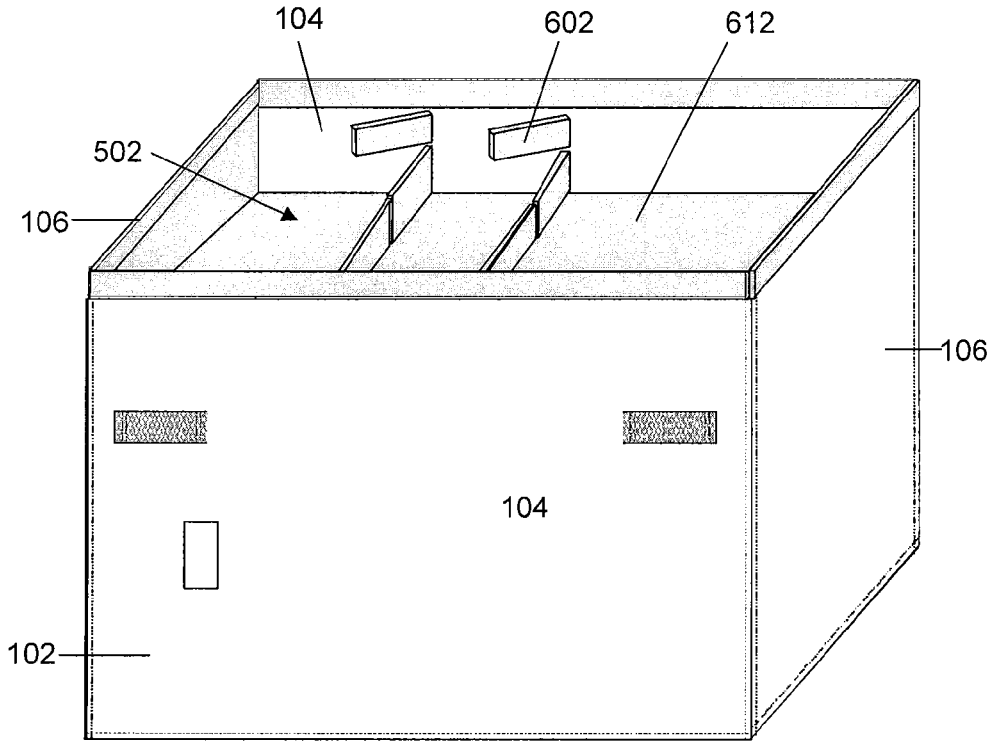
FIG. 22 shows a perspective view of a collapsible semi-bulk container having partial swing walls and a cassette according to one embodiment.

FIG. 22 depicts an embodiment of the collapsible container having a cassette 612 placed therein to define smaller compartments 502 in the container. The cassette 612 is square or rectangular. In some cases, the cassette 612 is simply a sheet of plywood, plastic, or other rigid material. In other cases, the cassette 612 is constructed from two pieces of material sewn or welded together to form a pocket for receiving a rigid panel, as described herein. The cassette 612 is sized to extend the width and length of the container and has a height that is less than the space 610 between the partial swing walls 602. The cassette 612 can be placed on the support provided by a layer of partial swing walls 602 and then the partial swing walls 602 above the cassette can be swung into the center of the container for defining a wall of the compartments 502 and for providing a base to create another tiered level. Thus, the compartments 502 have walls defined by the partial swing walls 602 and other parts of the container such as the front wall 102, the back wall 104, the opposing side walls 106, bottom, and lid.

Figure 23:
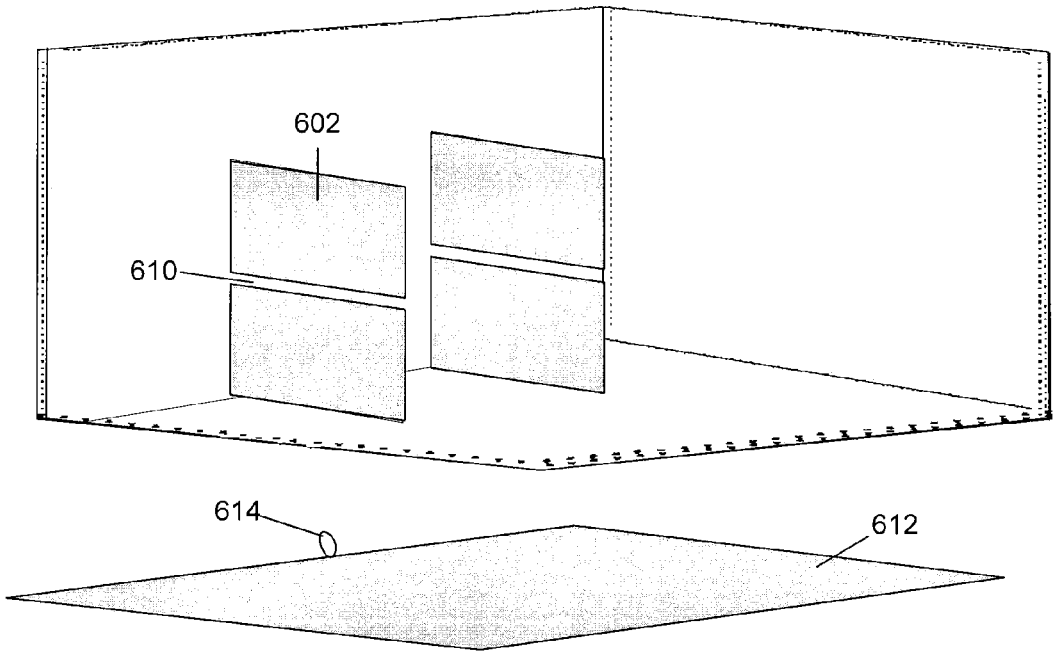
FIG. 23 shows a cutaway view of a collapsible semi-bulk container according to one embodiment.
Figure 24:
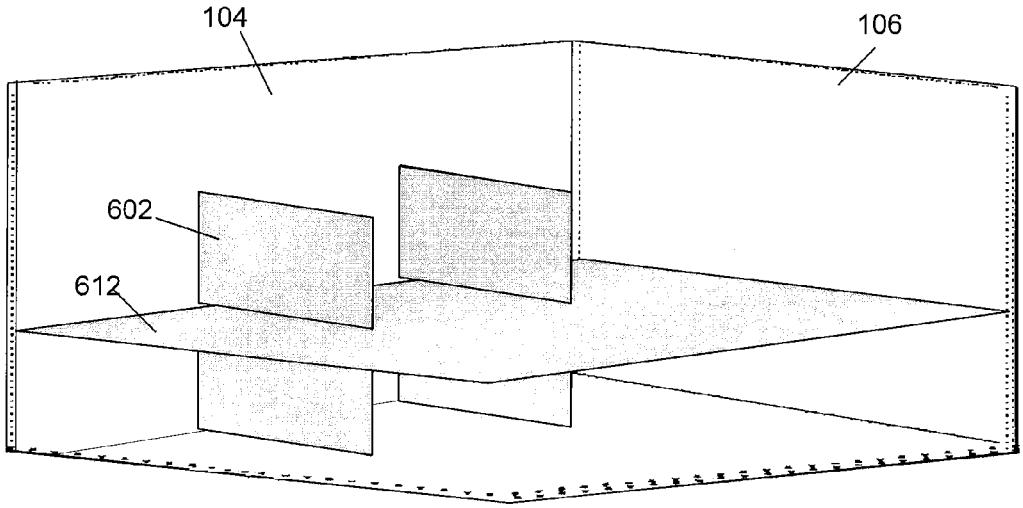
FIG. 24 shows a cutaway view of a collapsible semi-bulk container having partial swing walls and a cassette according to one embodiment.

FIGS. 23 and 24 depict a cutaway view of an interior of a collapsible semi-bulk container. The partial swing walls 602, space 610, and cassette 612 are designed so that smaller compartments having rigid walls may be created in a larger container. The container can also be collapsed easily when the cassettes 612 are removed and the partial swing walls are positioned substantially adjacent to the front wall 102 or the back wall 104. It should be understood that the height of the partial swing walls will affect the number of layers that can be placed in the container and that additional layers of partial swing walls can be included, each having a cassette defining a base and a top portion of the compartments.

Figure 27:
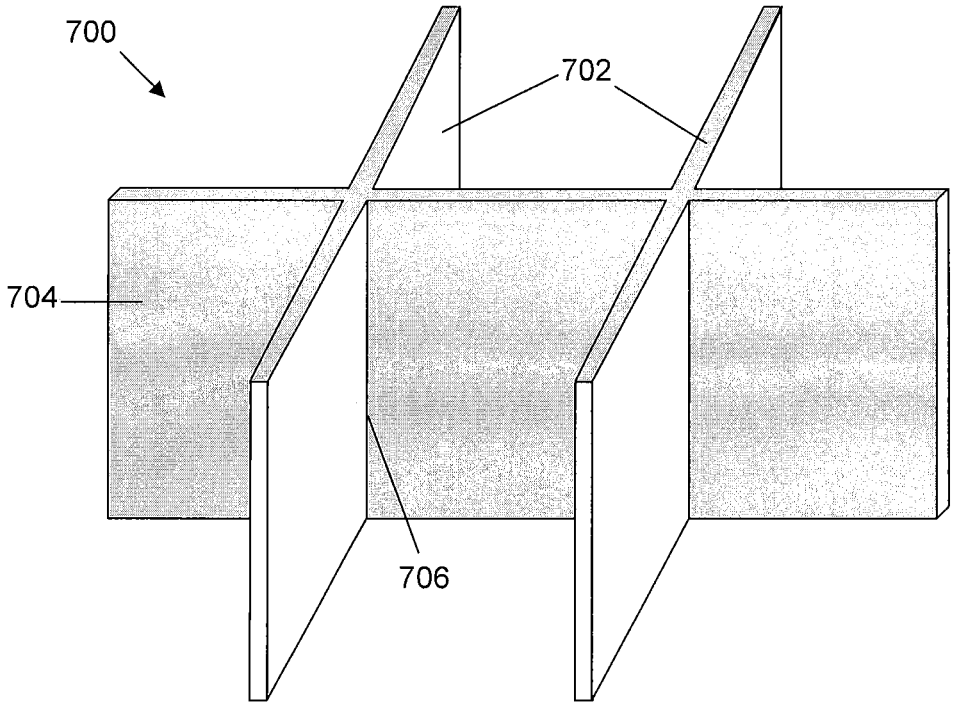
FIGS. 27 and 28 show a perspective view of a partition for use in a collapsible semi-bulk container according to an embodiment.
Figure 28:
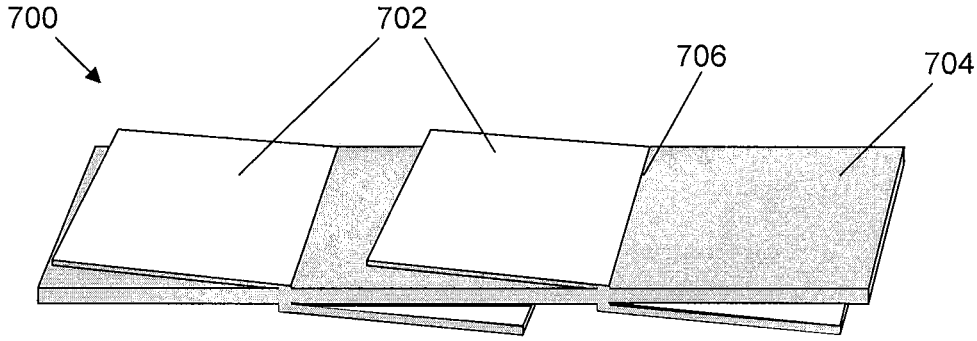

FIGS. 27 and 28 depict a perspective view of a partition 700 for a collapsible container. In some embodiments, the partition 700 divides the container into smaller compartments. The partition 700 includes lateral walls 702 and a center wall 704. Seams 706 connect the lateral walls 702 to the center wall 704. The partition 700 may be constructed of the same material as the container or of different material. In an embodiment, the partition 700 is sewn or welded together, as disclosed herein, and includes stiffening panels in pockets in the lateral walls 702 and center wall 704 of the partition. In some embodiments, the stiffening panels are sewn or welded into the lateral walls 702 and center wall 704. In other embodiments, the stiffening panels are inserted into the pockets and then the pockets are sealed with VELCRO®, adhesive, tape, or other attachment devices.

The partition 700 may be sized to fit within the collapsible containers disclosed herein. In particular, the partition 700 may be sized so that the lateral walls 702 contact the front wall 102 and back wall 104 of the container and the center wall 704 contacts the opposing side walls 106. In some embodiments (not shown), the lateral walls 702 and center wall 704 include attachment devices, such as VELCRO® or adhesive, that are configured to attach to matching attachment devices on the interior surfaces of the front wall, back wall, and opposing side walls of the container. In this manner, the partition 700 may be reversibly secured in the container but easily removable. In an embodiment, the partition 700 has a height to substantially match the height of the container. In another embodiment, the partition 700 has a height that is less than the height of the container. For example, the partition 700 may be used with a cassette 612 to define smaller compartments in a container.

In an embodiment depicted in FIG. 28, the partition 700 is configured to fold down when the lateral walls 702 are folded at the seams 706. The partition 700 may be folded down to a substantially flat configuration while the stiffening panels are still within the pockets. In this manner, the partition 700 may be used to create compartments in the containers but when the containers are collapsed for storage or transport, the partitions may also be folded down to reduce the space requirements for transport. Additionally, the stiffening panels may be removed from the pockets in the lateral walls 702 and center wall 704 so that the partition 700 may be folded into an even smaller space than when folded substantially flat with the stiffening panels in the pockets.

Figure 29:
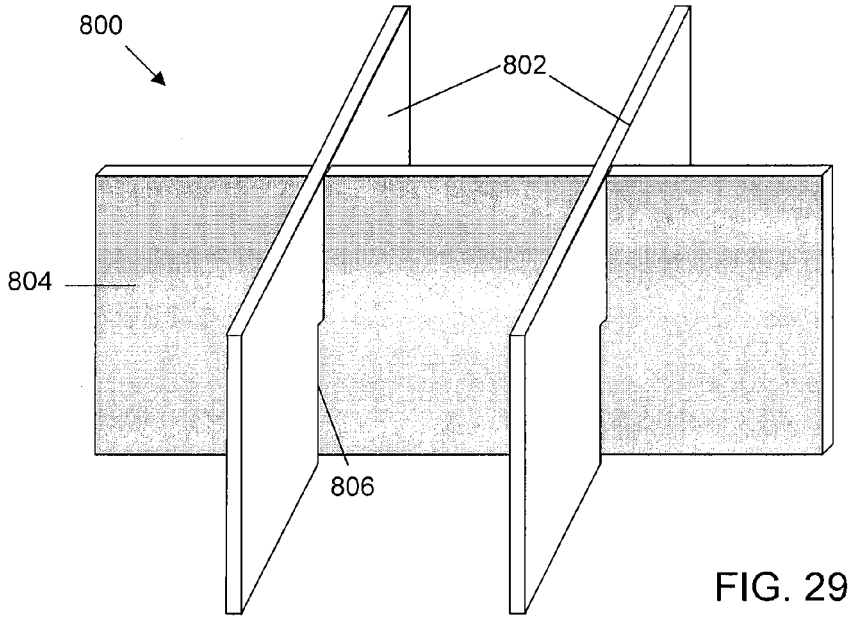
FIGS. 29 and 30 show a perspective view of a partition for use in a collapsible semi-bulk container according to an embodiment.
Figure 30:
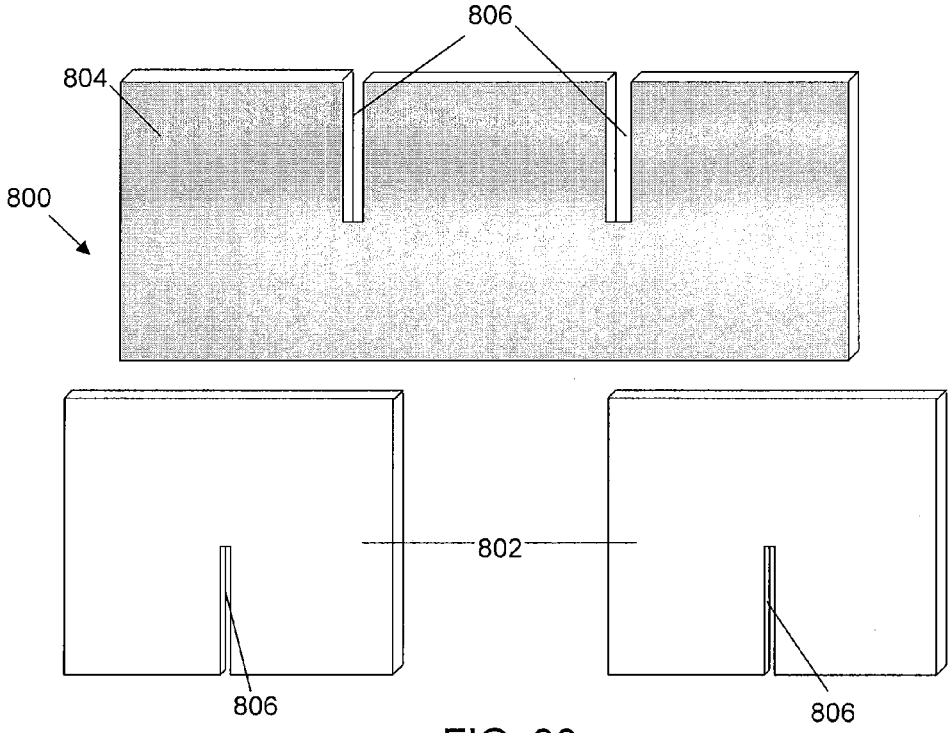

FIGS. 29 and 30 depict another embodiment of a partition 800 that allows the user to divide a container into smaller compartments. The partition 800 is made of the same or similar material as the containers, as disclosed herein. The partition 800 includes a lateral wall 802 and a center wall 804, wherein the lateral wall 802 and the center wall 804 are sized so that when the lateral walls 802 and center wall 804 are mated together the partition is the size of the interior of a container. The lateral walls 802 and center wall 804 include slots 806 for mating the lateral walls 802 with the center wall 804. For example, the slots 806 in the lateral walls 802 may be configured to closely receive the slots 806 in the center wall 804. In an embodiment, the slots 806 are a consistent height and width, such as half the height of the lateral walls 802 and center wall 804. In another embodiment, the sum of the height of the slot 806 in the lateral walls 802 and the height of the slot 806 in the center wall 804 is about equal to the height of the center wall 804. Stiffening panels are included in pockets in the lateral walls 802 and the center wall 804, and may be removable. For example, the pockets may be sealed with VELCRO®, adhesive, or other attachment devices. In another embodiment, the pockets are sewn or welded shut. When the slot 806 in the lateral wall 802 is inserted into the slot 806 in the center wall 804, the lateral wall 802 and the center wall 804 are substantially perpendicular and the partition 800 is free-standing. The lateral walls 802 and the center wall 804 can be separated so that multiple flat panels are provided, rather than a free-standing partition. When the lateral walls 802 and the center wall 804 are separated, the partition 800 may be packed into a small space for shipping.

It should be understood that the partitions 700, 800 may be made with a wide variety of number of lateral walls 702, 802. While FIGS. 27 and 29 depict the partitions 700, 800 as including a single center wall and two lateral walls 702, 802 on either side of the center wall 704, 804, more than or less than two lateral walls may be included in the partition. In addition, multiple center walls 804 having slots 806 may be included such that when the slots in the center walls 804 and the lateral walls 802 are mated, the partition 800 is sized to fit within a container or on top of a cassette 612 for creating smaller compartments within a container.

In another aspect of the invention, a method for storing content in semi-bulk containers is provided. In an embodiment, the method includes providing containers as described herein, erecting the containers so that they can receive content, filling the containers with content, unloading the content from the containers after storage and/or transport, and then collapsing the containers for easy transport. The containers can be stored and transported in a stacked position and because of the square or rectangular shape of the containers, storage spaces can be efficiently utilized with the containers. Collapsing the containers occurs as described herein and allows the containers to be reduced to a fraction of their size. The method provides several advantages over the previously known methods including that the containers are lightweight and reusable, that the containers are strong enough to be stacked five high with heavy loads yet can be folded down when not needed, and that the method allows manufacturers to save money and time by having an efficient use of space when shipping the containers loaded and when shipping the empty containers.

Although the invention has been variously disclosed herein with reference to illustrative embodiments and features, it will be appreciated that the embodiments and features described hereinabove are not intended to limit the invention, and that other variations, modifications and other embodiments will suggest themselves to those of ordinary skill in the art, based on the disclosure herein. The invention therefore is to be broadly construed, as encompassing all such variations, modifications and alternative embodiments within the spirit and scope of the claims hereafter set forth.

I claim:

1. A collapsible semi-bulk container, the container comprising:

four walls connected end to end to define four corners, the four walls consisting of a front wall, a back wall, a first opposing side wall, and a second opposing side wall, wherein the front wall and the back wall comprise stiffening panels, wherein the stiffening panels are positioned in pockets within the front wall and the back wall;

a girdle attached to two opposing walls and configured to reduce deflection in the two opposing walls, the girdle comprising a first material attached to one of the two opposing walls and a second material attached to the other of the two opposing walls, wherein the first material and the second material are reversibly connectable, and wherein the two opposing walls are either the front wall and the back wall or the first opposing side wall and the second opposing side wall;

a first swing wall attached to a corner defined by the back wall and the first opposing side wall, wherein the first swing wall can be moved between a position substantially adjacent to the back wall and a position substantially adjacent to the first opposing side wall when the four walls are vertical;

a second swing wall attached to a corner defined by the back wall and the second opposing side wall, wherein the second swing wall can be moved between a position substantially adjacent to the back wall and a position substantially adjacent to the second opposing side wall when the four walls are vertical; and attachment devices on the swing walls and the opposing side walls, the attachment devices configured to secure the swing walls substantially adjacent to the opposing side walls.

2. The container of claim 1, wherein the front wall defines the pocket between two pieces of material welded together, and wherein the back wall defines the pocket between two pieces of material welded together.

3. The container of claim 1, further comprising a base attached to a bottom edge of at least one wall.

4. The container of claim 1, wherein the stiffening panel is selected from the group consisting of plywood, corrugated plastic, metal, and cardboard.

5. The container of claim 1, wherein the container can be collapsed when the swing walls are moved to the position substantially adjacent to the back wall.

6. The container of claim 1, further comprising:

at least one partial swing wall, an end of the partial swing wall attached to the back wall;

at least one opposing partial swing wall, an end of the opposing partial swing wall attached to the front wall;

wherein the partial swing wall can be moved between a position substantially adjacent to the back wall and a position substantially perpendicular to the back wall, and wherein the opposing partial swing wall can be moved between a position substantially adjacent to the front wall and a position substantially perpendicular to the front wall.

7. The container of claim 6, wherein the container is collapsible when the partial swing wall is moved to the position substantially adjacent to the back wall and the opposing partial swing wall is moved to the position substantially adjacent to the front wall.

8. The container of claim 6, further comprising at least one cassette configured to be supported by a top edge of the partial swing wall and the opposing partial swing wall.

9. The container of claim 1, wherein the opposing side walls comprise a central vertical seam and a stiffening panel in a pocket formed on either side of the central vertical seam.

10. Wherein the exterior of each opposing side wall comprises a tab connected across the central vertical seam which prevents the side wall from folding outwards.

11. The container of claim 1, further comprising a door in at least one of the four walls.

12. The container of claim 11, wherein the door is of a lower height than a wall on either side of the door so that pressure is not exerted on the door when pressure is applied to a top edge of the four walls of the container.

13. The container of claim 11, wherein the door includes attachment means to secure the door in a closed position.

14. The container of claim 1, further comprising:

at least one fabric baffle connected to the two opposing walls, the at least one fabric baffle defining at least two compartments in the container.

15. The container of claim 14, wherein the fabric baffle comprises at least one pocket configured to receive a stiffening panel.

16. The container of claim 14, further comprising additional swing walls configured to be movable between a position substantially adjacent to the back wall and a position substantially adjacent to the fabric baffle.

17. The container of claim 14, further comprising partial swing walls configured to create tiered levels in the compartments created by the fabric baffle.

18. A method for storing content in semi-bulk containers, the method comprising:

providing a container, the container comprising:

a front wall, a back wall, wherein the front wall and the back wall comprise stiffening panels positioned in pockets within the front wall and the back wall;

a first opposing side wall, a second opposing side wall, a girdle attached to two opposing walls and configured to reduce deflection in the two opposing walls, the girdle comprising a first material attached to one of the two opposing walls and a second material attached to the other of the two opposing walls, wherein the first material and the second material are reversibly connectable, and wherein the two opposing walls are either the front wall and the back wall or the first opposing side wall and the second opposing side wall;

a first swing wall attached to a corner defined by the back wall and the first opposing side wall, wherein the first swing wall can be moved between a position substantially adjacent to the back wall and a position substantially adjacent to the first opposing side wall when the four walls are vertical;

a second swing wall attached to a corner defined by the back wall and the second opposing side wall, wherein the second swing wall can be moved between a position substantially adjacent to the back wall and a position substantially adjacent to the second opposing side wall when the four walls are vertical; and attachment devices on the swing walls and the opposing side walls, the attachment devices configured to secure the swing walls substantially adjacent to the opposing side walls;

erecting the container in an upright position using the two swing walls for supporting the container in an upright position;

loading content into the container;

unloading the content from the container;

reversing the swing walls; and collapsing the container.

* * * * *